US005699585A

United States Patent [19]

Tomooka et al.

[11] Patent Number: 5,699,585

[45] Date of Patent: Dec. 23, 1997

[54] ELECTRIC VACUUM CLEANER

[75] Inventors: Yutaka Tomooka, Takatsuki; Yasuhiro Oka, Osaka, both of Japan

[73] Assignee: Sharp Kabushiki Kaisha, Osaka, Japan

[21] Appl. No.: 543,650

[22] Filed: Oct. 16, 1995

[30] Foreign Application Priority Data

Oct. 31, 1994 [JP] Japan ..... HEI 6-266858
Feb. 22, 1995 [JP] Japan ..... HEI 7-033814

[51] Int. Cl.[6] ..... A47L 5/36

[52] U.S. Cl. ..... 15/327.2; 15/327.7; 15/347; 15/352; 55/378; 55/429

[58] Field of Search ..... 55/378, 429; 15/347, 15/352, 327.7, 327.1, 327.2

[56] References Cited

U.S. PATENT DOCUMENTS 5,014,385 5/1991 Bradd et al. .

FOREIGN PATENT DOCUMENTS 61-67646 5/1986 Japan .
64-2680 1/1989 Japan .
3-17816 4/1991 Japan .
484372 5/1938 United Kingdom .
765857 1/1957 United Kingdom .
862753 3/1961 United Kingdom .
1379162 1/1975 United Kingdom .

*Primary Examiner*—Chris K. Moore

[57] ABSTRACT

An electric vacuum cleaner includes: a catching mechanism disposed in the appliance housing for detachably catching a dust collecting bag for collecting dust, dirt and the like; a releasing lever allowing a releasing operation from the outside to free the engaged state of the dust collecting bag in the catching mechanism; and/or two type of accessory suction nozzles including a brush-equipped suction nozzle with bristles and a gap-cleaning suction nozzle having an elongate nozzle portion for cleaning gaps; and a depressed storage portion for fitting accessory suction nozzles in the appliance body. In this configuration, the suction nozzles can be attached to the depressed storage portion by inserting the nozzle portion of the gap-cleaning suction nozzle into the brush-equipped suction nozzle and fitting the integrally fitted part consisting of the brush-equipped suction nozzle and the gap-cleaning suction nozzle, into the depressed storage portion.

9 Claims, 20 Drawing Sheets

ELECTRIC VACUUM CLEANER

BACKGROUND OF THE INVENTION

1. Field of the Invention

The present invention relates to an electric vacuum cleaner and more preferably relates to an improved device for attaching and detaching of a dust collecting bag for the vacuum cleaner as well as to an improved storing device for storing attached suction nozzles for the vacuum cleaner into the appliance body.

2. Description of the Prior Art

As to electric cleaners, various kinds of improvement have been proposed conventionally. Of these, there are types of electric cleaners which have a detachable dust collecting bag in a dust collecting chamber inside the appliance housing so as to allow the dust collecting bag to be replaced. Two kinds of structures are known as to the cleaners of this type: one of which has a lidding member which is attached to the appliance housing and can be opened and closed for the dust collecting bag to be replaced. In the other structure, the dust collecting bag is replaced by separating the appliance housing.

FIGS. 1 and 2 show an electric vacuum cleaner having a lidding member for a dust collecting bag to be replaced. In FIG. 1, an appliance housing 41 is so arranged as to divide the inside into two parts, that is, a dust collecting chamber 42 and a motor room 44 holding an electric fan 43. A connecting port 45 for connecting a connecting hose (not shown) therewith is formed in the appliance housing 41 so as to be projected into the side of dust collecting chamber 42. A dust collecting bag 47 with an attachment frame 46 is attached to the connecting port 45 on the side of the dust collecting chamber 42 while a catching device 48 for fixing the dust collecting bag 47 is provided for the dust collecting chamber 42 in the vicinity of the connecting port 45. The housing 41 further has a lidding member 49 for opening and closing an opening formed on the upper part of the dust collecting chamber 42.

Particularly, as shown in FIG. 2, the width E of the lower part of the dust collecting chamber 42 is approximately equal to the width of the dust collecting bag 47 when it is inflated to the maximum. The width F of the upper part of the dust collecting chamber 42 is designed to be smaller than the width E of the lower part of the dust collecting chamber 42.

When the dust collecting bag 47 is to be replaced in the above electric vacuum cleaner having the dust collecting bag 47 replaced by opening the lidding member 49, the dust collecting bag 47 is replaced by opening the lidding member 49 for covering the opening on the top of the dust collecting chamber 42; releasing the engagement between the attachment frame 46 and the catching device 48 by fingering the catching device 48 in a disengaging direction; detaching the dust collecting bag 47 through the top opening of the dust collecting chamber 42; and placing a new dust collecting bag 47.

As disclosed in Japanese Utility Model Publication Sho 64 No. 2,680, an electric vacuum cleaner in which a dust collecting bag is replaced by separating the appliance housing is configured as shown in FIGS. 3 and 4. In FIGS. 3 and 4, the electric vacuum cleaner has an appliance housing 51 which is formed of and can be separated into a dust collecting casing 53 having a dust collecting chamber 52 and a motor casing 55 having an electric fan 54 therein. A connecting port 56 for connecting a connecting hose (not shown) is formed in the dust collecting casing 53 on the opposite side of an opening 53a of the dust collecting casing 53 which is joined to the motor casing 55, in such a manner that the connecting port 56 is projected into the dust collecting chamber 52. A dust collecting bag 58 having an attachment frame 57 is attached to the connecting port 56 on the side of the dust collecting chamber 52. The dust collecting chamber 52 further has a frame member 59 which is detached together with the dust collecting bag 58 from the dust collecting casing 53 through the opening 53a thereof.

The aforementioned frame member 59 is integrally formed of a catching device 60 for holding the dust collecting bag 58 by catching the attachment frame 57 and a seal packing 61 for forming a hermetic joint between the dust collecting casing 53 and the motor casing 55.

In the electric vacuum cleaner in which the dust collecting bag 58 is replaced by separating the appliance housing 51, the dust collecting bag 58 is replaced by separating the appliance housing 51 into the dust collecting casing 53 and the motor casing 55; detaching the dust collecting bag 58 together with the frame member 59 through the opening 53a of the dust collecting casing 53; releasing the engagement of the attachment frame 57 by fingering the catching device 60 in a disengaging direction; and replacing the old dust collecting bag 58 with new one.

In the electric vacuum cleaner with the lidding member 49 being opened and closed when the dust collecting bag 47 is replaced, the width F of the upper part of the dust collecting chamber 42 is smaller than the width E of the lower part of the dust collecting chamber 42, as mentioned above. Therefore, when the dust collecting bag 47 totally expanded inside the lower part of the dust collecting chamber 42 is to be detached through the upper opening of the dust collecting chamber 42, the dust collecting bag 47 is caught by the inner face of the dust collecting casing defining the upper part of the dust collecting chamber 42, thus making it difficult to take the dust collecting bag 47 out.

On the other hand, in the electric vacuum cleaner in which the dust collecting bag 58 is replaced by decomposing the appliance housing 51, since the dust collecting bag 58 is detached together with the frame member 59 from the dust collecting casing 53 through the opening 53a thereof, the dust collecting bag 58 must be detached from the frame member 59 by releasing the engagement of the catching device 60 with the attachment frame 57. That is, the replacement requires extra handling time and labor.

Meanwhile, there are electric vacuum cleaners which incorporate an electric fan in a main body thereof and have a depressed portion for storing accessory suction nozzles therein. A typical electric vacuum cleaner of this kind has been disclosed in Japanese Utility Model Publication Hei 3 No. 17,816 and will be described hereinafter with reference to FIG. 5. This cleaner comprises: a cleaner body 121 with an electric fan (not shown) incorporated therein; a pair of wheels 122 on both sides of the cleaner body 121; a storage 125 disposed on top of the cleaner body 121 for storing accessory suction nozzles such as a brush-equipped suction nozzle 123 having bristles and a gap-cleaning suction nozzle 124 having an elongate nozzle portion for cleaning gaps; a depressed portion corresponding to the shapes of the brush-equipped suction nozzle 123 and the gap-cleaning suction nozzle 124; a lid 126 disposed on the top of cleaner body 121 for opening and closing the storage 125; a connecting port 127 disposed on the front side of the cleaner body 121 for connecting an extension hose (not shown); and an extension tube (not shown) which is connected to the extension hose at one end and jointed at the opposite end with one of the aforementioned brush-equipped suction nozzle 123 or gap-cleaning suction nozzle 124.

Another conventional electric vacuum cleaner will be described referring to FIG. 6. This cleaner comprises: a cleaner body 131 with an electric fan (not shown) incorporated therein; a pair of wheels 132 on both sides of the cleaner body 131; a pivoting handle 133 disposed on the top of the cleaner body 131; a depressed storage portion 135 disposed in the rear lower portion of the cleaner body 131 for storing a gap-cleaning suction nozzle 134 fitted therein.

Another example of conventional electric vacuum cleaners is found in Japanese Utility Model Application Laid-Open Sho 61 No. 67,646. This electric vacuum cleaner is formed with a pair of U-shaped cutout portions on the rear upper part of the appliance housing and has a storage for suction nozzles below the cutout portions so that shelf-cleaning and gap-cleaning suction nozzles are fitted in respective U-shaped cutout portions.

In the case of the electric vacuum cleaner shown in FIG. 5, since two depressed holding portions must be provided on the top surface of the cleaner body in order to store the brush-equipped and gap-cleaning suction nozzles, respectively, the appliance body tends to become bulky and heavy, requiring a large storage space for keeping the appliance and making it difficult to use or deteriorating its handling performance. Further, the lid for opening and closing the storage tends to be broken.

In the case of the electric vacuum cleaner shown in FIG. 6, the depressed storage can only hold the gap-cleaning suction nozzle fitted therein. If there are a plurality of accessory suction nozzles, a plurality of depressed storage portions should be formed in conformity with the number of the accessory suction nozzles, like the former configuration. Therefore, the appliance body again tends to become bulky and heavy, requiring a large storage space for keeping the appliance and making it difficult to use or deteriorating its handling performance.

In the aforementioned configuration disclosed in Japanese Utility Model Application Laid-Open Sho 61 No. 67,646, since the shelf-cleaning suction nozzle and the gap-cleaning suction nozzle are fitted into respective cutout portions and stored separately, two storage spaces corresponding to the shelf-cleaning and gap-cleaning suction nozzles are required, whereby it is impossible to make the storage room compact.

SUMMARY OF THE INVENTION

The electric vacuum cleaner of the present invention has been invented to solve the above problems and it is therefore an object of the present invention to provide an electric vacuum cleaner wherein when a dust collecting bag is replaced, the dust collecting bag will not be caught between interior walls of a dust collecting casing and the dust collecting bag can easily be replaced by taking the dust collecting bag out in a single-step operation without requiring any troublesome handling for the replacement.

It is another object of the present invention to provide a compact electric vacuum cleaner by constructing suction nozzles and a storage portion therefor in such a manner that storage of the suction nozzles is done by integrally fitting the nozzle portion of a gap-cleaning suction nozzle into a brush-equipped suction nozzle and fitting the integrated suction nozzles to a depressed storage portion, to thereby reduce the size of the suction nozzles when stored and the storage space for the suction nozzles.

The present invention has been achieved to attain the above objects, and in accordance with a first aspect of the invention, an electric vacuum cleaner having an appliance body composed of a motor casing portion having an electric fan therein and a dust collecting casing portion having a dust collecting chamber, comprises: an appliance housing; a catching means disposed in the appliance housing for detachably catching a dust collecting bag collecting dust, dirt and the like; and a releasing means allowing a releasing operation from the outside to free the engaged state of the dust collecting bag in the catching means.

In accordance with a second aspect of the invention, an electric vacuum cleaner having an appliance body composed of a motor casing portion having an electric fan therein and a dust collecting casing portion having a dust collecting chamber, comprises: an appliance housing composed of and separated into a dust collecting casing having a dust collecting chamber and a motor casing having an electric fan therein; and a catching means disposed in the dust collecting chamber for detachably catching a dust collecting bag for collecting dust, dirt and the like, and is constructed so that the dust collecting bag is adapted to be removed through an opening of the dust collecting casing where the dust collecting casing is to be joined to the motor casing; and the dust collecting casing is constructed so that the section of the dust collecting casing becomes gradually greater in width toward the opening of the dust collecting casing.

In the above configuration, any of the following features is effective: the electric vacuum cleaner further includes an air-sealing means for hermetically sealing the jointing face between the dust collecting casing and the motor casing and a groove portion for holding the air-sealing means so as not to project inward of the inner surface of the dust collecting casing; the electric vacuum cleaner further includes a preventing means for preventing the releasing means from effecting the releasing operation when the dust collecting casing are being joined to the motor casing; and the electric vacuum cleaner further includes an operation-disabling means for disabling the operation of the cleaner when the dust collecting bag is not engaged in the catching means.

In accordance with another aspect of the present invention, an electric vacuum cleaner having an appliance body composed of a motor casing portion having an electric fan therein and a dust collecting casing portion having a dust collecting chamber, comprises: two type of accessory suction nozzles including a brush-equipped suction nozzle with bristles and a gap-cleaning suction nozzle having an elongate nozzle portion for cleaning gaps; and a depressed storage portion for fitting the accessory suction nozzles in the appliance body, and is constructed so that the depressed storage portion is constructed so that the suction nozzles can be attached to the depressed storage portion by inserting the nozzle portion of the gap-cleaning suction nozzle into the brush-equipped suction nozzle and fitting the integrally fitted part consisting of the brush-equipped suction nozzle and the gap-cleaning suction nozzle, into the depressed storage portion.

In the above configuration, any of the following features is effective: the fitting portion provided for the brush-equipped suction nozzle to be fitted to the depressed storage portion and the fitting portion provided for the gap-cleaning suction nozzle to be fitted to the depressed storage portion have an identical outside diameter, so that any one of the brush-equipped suction nozzle and gap-cleaning suction nozzle can be fitted and stored into the depressed storage portion; and a front end of the nozzle portion of the gap-cleaning suction nozzle is formed to be inclined; and a length from the frontmost position of the nozzle portion to the boundary to the fitting portion is so set up as not to abut the interior surface of the brush-equipped suction nozzle when the nozzle portion is inserted into the brush-equipped suction nozzle.

In accordance with still another aspect of the present invention, an electric vacuum cleaner having an appliance body composed of a motor casing portion having an electric fan therein and a dust collecting casing portion having a dust collecting chamber, comprises: an appliance housing composed of and separated into a dust collecting casing having a dust collecting chamber and a motor casing having an electric fan therein; a catching means disposed in the dust collecting chamber for detachably catching a dust collecting bag for collecting dust, dirt and the like; a releasing means allowing a releasing operation from the outside to free the engaged state of the dust collecting bag in the catching means; two type of accessory suction nozzles including a brush-equipped suction nozzle with bristles and a gap-cleaning suction nozzle having an elongate nozzle portion for cleaning gaps; and a depressed storage portion for fitting the accessory suction nozzles in the appliance body, and is constructed such that the dust collecting bag can be removed from an opening where the dust collecting casing is to be joined to the motor casing, by separating the appliance housing into the collecting casing and the electric casing and effecting the releasing operation by the releasing means; and the depressed storage portion is constructed so that the suction nozzles can be attached to the depressed storage portion by inserting the nozzle portion of the gap-cleaning suction nozzle into the brush-equipped suction nozzle and fitting the integrally fitted part consisting of the brush-equipped suction nozzle and the gap-cleaning suction nozzle, into the depressed storage portion.

In the above configuration, any of the following features is effective: the dust collecting casing is constructed so that the section of the dust collecting casing becomes gradually greater in width toward the opening of the dust collecting casing; the electric vacuum cleaner further includes an air-sealing means for hermetically sealing the jointing face between the dust collecting casing and the motor casing; and a groove portion for holding the air-sealing means so as not to project inward of the inner surface of the dust collecting casing; the electric vacuum cleaner includes a preventing means for preventing the releasing means from effecting the releasing operation when the dust collecting casing are being joined to the motor casing; an operation-disabling means for disabling the operation of the cleaner when the dust collecting bag is not engaged in the catching means; the fitting portion provided for the brush-equipped suction nozzle to be fitted to the depressed storage portion and the fitting portion provided for the gap-cleaning suction nozzle to be fitted to the depressed storage portion have an identical outside diameter, so that any one of the brush-equipped suction nozzle and gap-cleaning suction nozzle can be fitted and stored into the depressed storage portion; and a front end of the nozzle portion of the gap-cleaning suction nozzle is formed to be inclined, and a length from the frontmost position of the nozzle portion to the boundary to the fitting portion is so set up as not to abut the interior surface of the brush-equipped suction nozzle when the nozzle portion is inserted into the brush-equipped suction nozzle.

Since the electric vacuum cleaner of the invention is thus constructed, the replacement of the dust collecting bag can be done by operating the releasing means from the outside of the appliance housing to release the engaged state of the dust collecting bag in the catching means. In consequence, it is possible for the operator to remove the dust collecting bag easily in the single-step operation without requiring any troublesome handling for the replacement.

Since, in the present invention, the dust collecting casing is formed so that the section of the dust collecting casing becomes gradually greater in width toward the opening of the casing; when the appliance housing is separated into the dust collecting casing and the motor casing thereafter the releasing lever is freed with the opening of the dust collecting casing down, it is possible to take the dust collecting bag out by allowing the bag not to be caught between the inner walls of the dust collecting casing but to slide down smoothly.

Further, in the above configuration of the present invention, since a groove portion is provided so as not to allow the air-sealing means to project out from the level of the inner wall of the dust collecting casing, the dust collecting bag can be removed smoothly without being caught by the air-sealing means when the dust collecting bag is taken out by sliding it down. Further, since the air-sealing means is provided inside the peripheral wall of the dust collecting casing, it is possible to form a perfectly hermetic state at the joining surface between the dust collecting casing and the motor casing, without degrading the outside appearance of the appliance housing.

Moreover, in the above configuration of the present invention, since the blocking means prevents the releasing means from effecting disengagement of the dust collecting bag while the dust collecting casing and the motor casing are being joined, the dust collecting bag will not get out of place unexpectedly during cleaning, so that it is possible to prevent the appliance from breaking due to the pollution of dust and dirt inside the appliance which would be caused by unexpected disengagement of the dust collecting bag.

In addition, in the above configuration, the operation of the cleaner is disabled by the operation-disabling means when the dust collecting bag is not engaged by the catching means, to thereby warn the operator of the failure to attach the dust collecting bag. In consequence, it is possible to prevent the appliance from breaking due to the pollution of dust and dirt inside the appliance which would be caused by the default of attaching the dust collecting bag.

On the other hand, since in the electric vacuum cleaner of the present invention, the storage of the suction nozzles is done by integrally fitting the nozzle portion of the gap-cleaning suction nozzle into the brush-equipped suction nozzle and fitting the integrated suction nozzles to the depressed storage portion, it is possible to reduce the size of the suction nozzles when stored, thus making it possible to reduce the storage space for the suction nozzles. In consequence, the cleaner body itself can also be made compact.

In the above electric vacuum cleaner, since the fitting portion of the brush-equipped suction nozzle and the fitting portion of the gap-cleaning suction nozzle have an identical outside diameter; when the brush-equipped suction nozzle is used, it is possible to fit and store the gap-cleaning suction nozzle alone in the depressed storage portion. It is also possible to fit and store the brush-equipped suction nozzle alone in the depressed portion when the gap-cleaning suction nozzle is in use.

In the above electric vacuum cleaner, since the length of the front part of the nozzle portion of the gap-cleaning suction nozzle is so set up as not to abut the interior surface of the brush-equipped suction nozzle; when the nozzle portion of the gap-cleaning suction nozzle is inserted into the brush-equipped suction nozzle, it is possible to insert the gap-cleaning suction nozzle into the brush-equipped suction nozzle, with its frontmost part directed to any direction.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Embodiments of electric vacuum cleaners of the present invention will hereinafter be described in detail, with reference to FIGS. 7 through 17.

Figure 1:
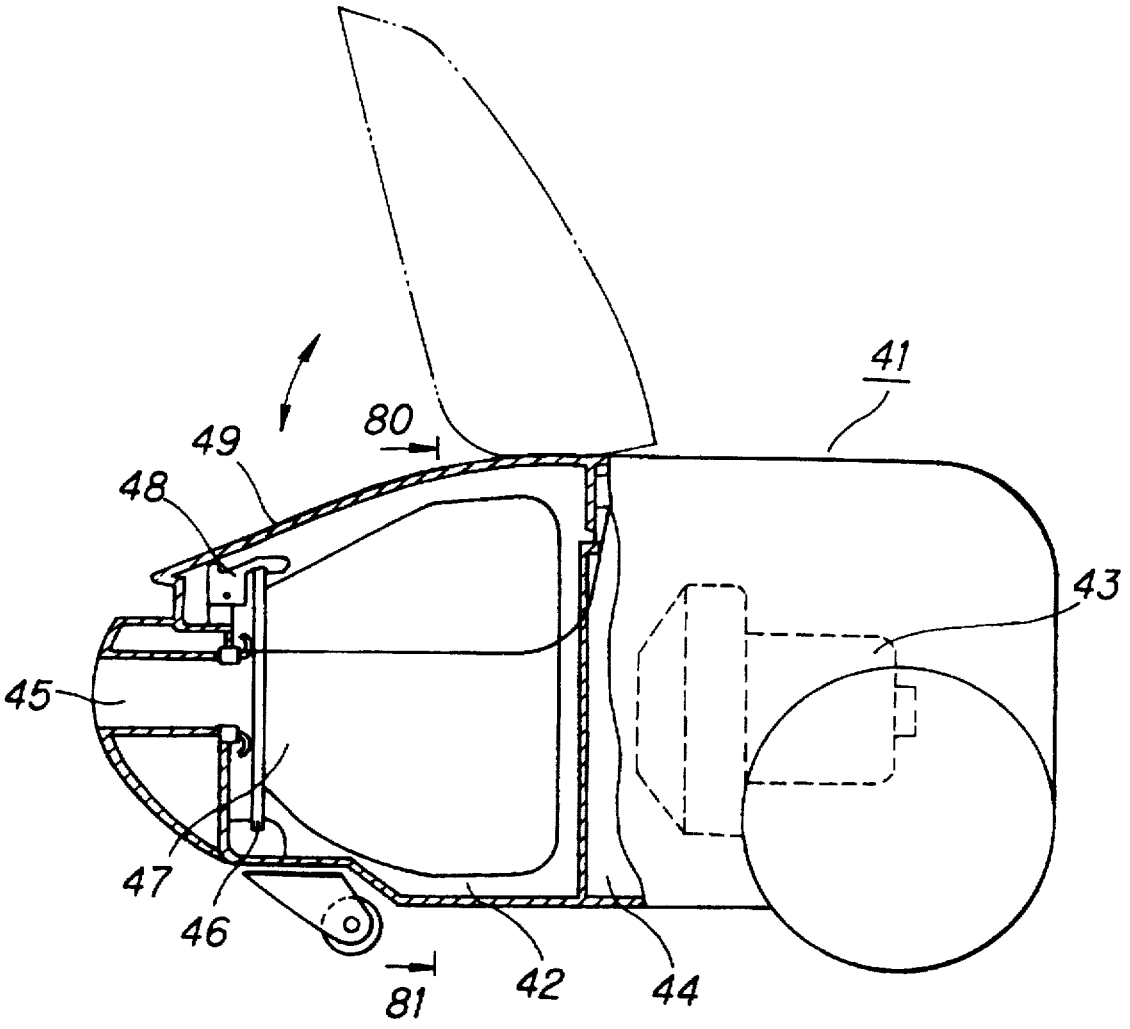
FIG. 1 PRIOR ART
FIG. 1 is a sectional side view showing essential components of a conventional electric vacuum cleaner in which a lidding member is opened and closed when a dust collecting bag is replaced.
Figure 2:
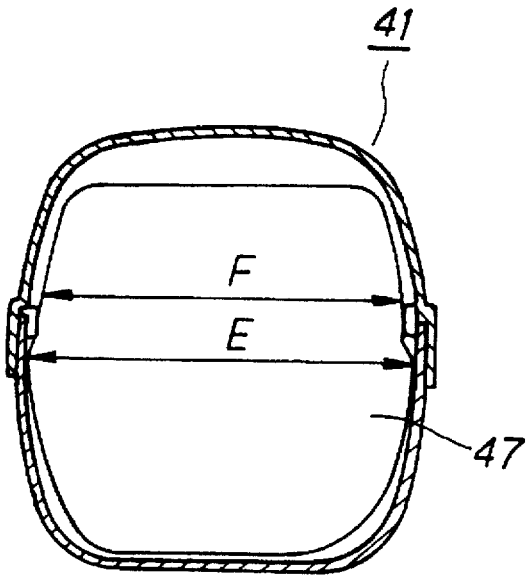
FIG. 2 PRIOR ART
FIG. 2 is a sectional view showing essential components (taken on 80-81 in FIG. 1)
Figure 3:
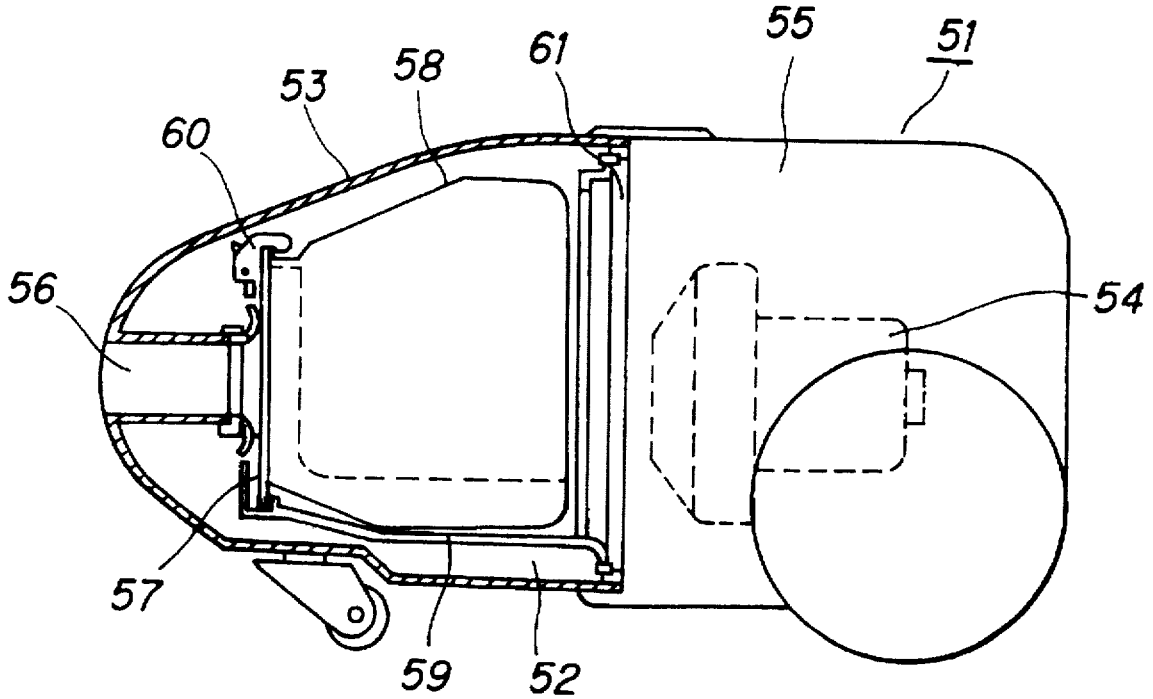
FIG. 3 PRIOR ART
FIG. 3 is a sectional side view showing essential components of a conventional electric vacuum cleaner in which an appliance housing is separated when a dust collecting bag is replaced.
Figure 4:
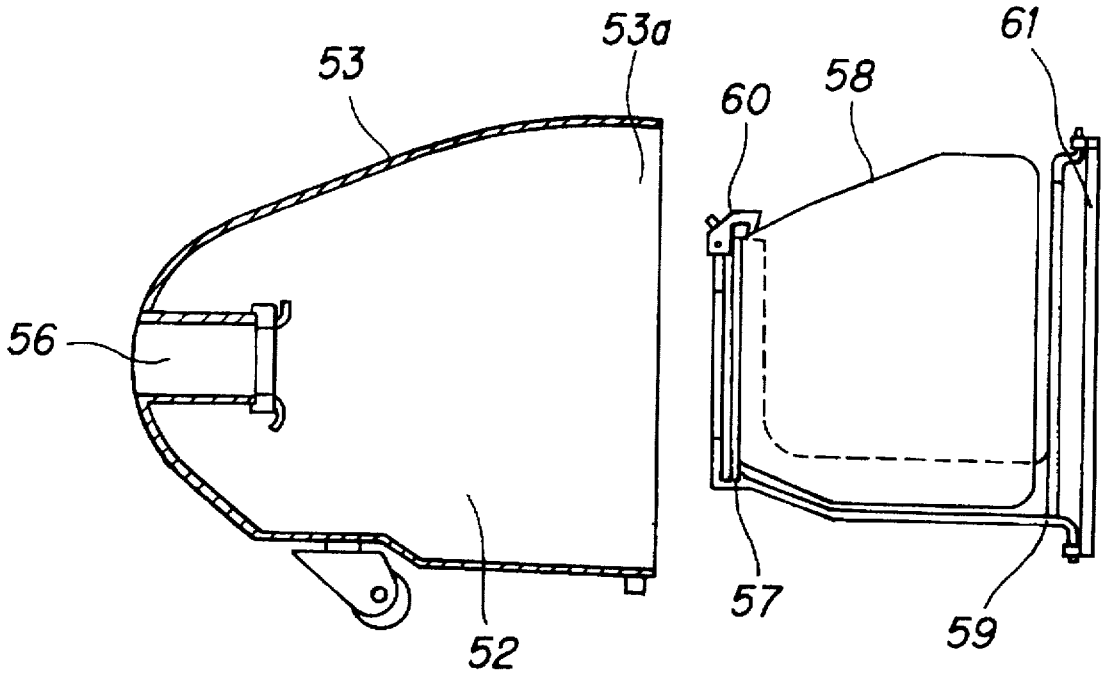
FIG. 4 PRIOR ART
FIG. 4 is a sectional side view showing essential components in which a dust collecting bag is taken out from a dust collecting casing shown in FIG. 3.
Figure 5:
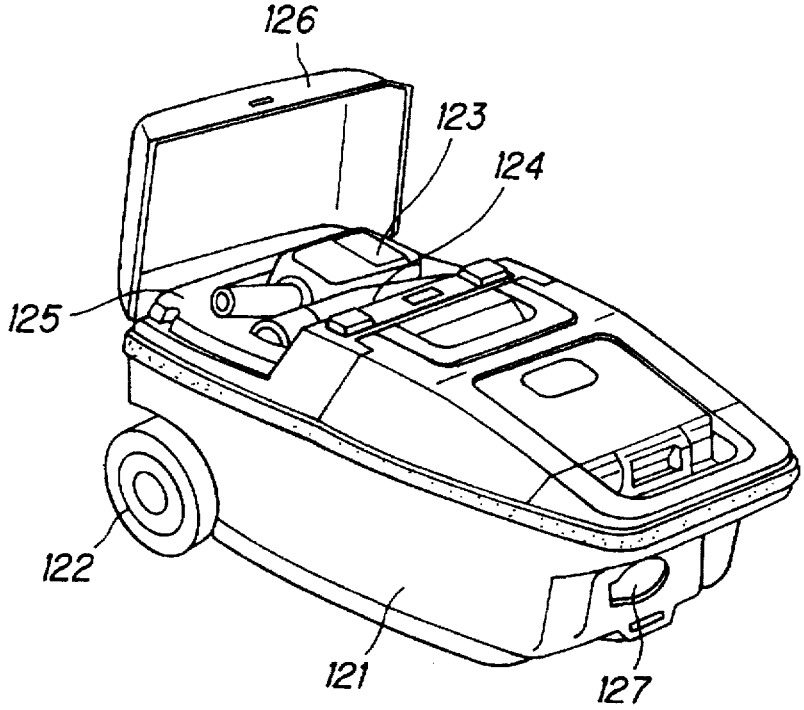
FIG. 5 PRIOR ART
FIG. 5 is a perspective view showing an example of a conventional electric vacuum cleaner.
Figure 6:
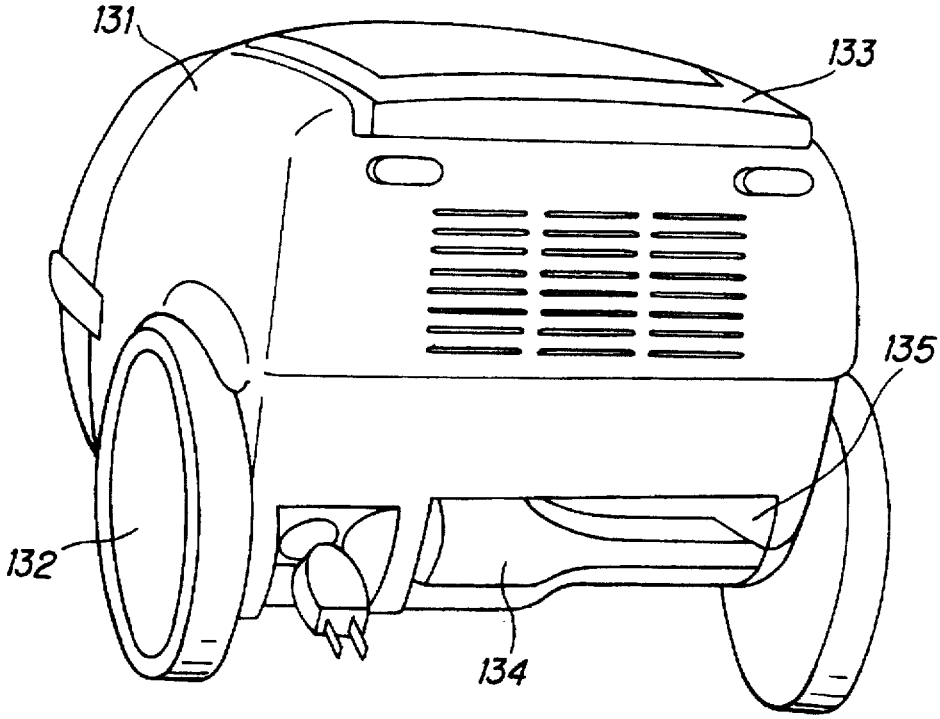
FIG. 6 PRIOR ART
FIG. 6 is a perspective view showing another example of a conventional electric vacuum cleaner.
Figure 7:
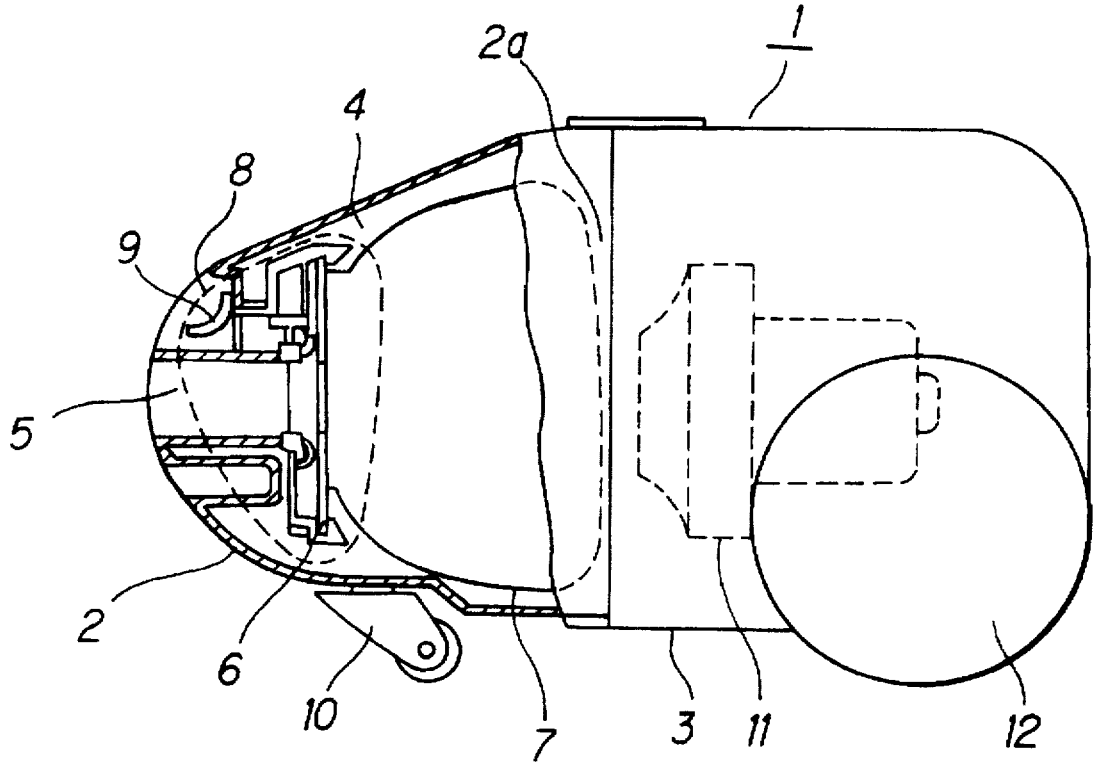
FIG. 7 is a sectional side view showing essential components of a first embodiment of an electric vacuum cleaner of the present invention.
Figure 8:
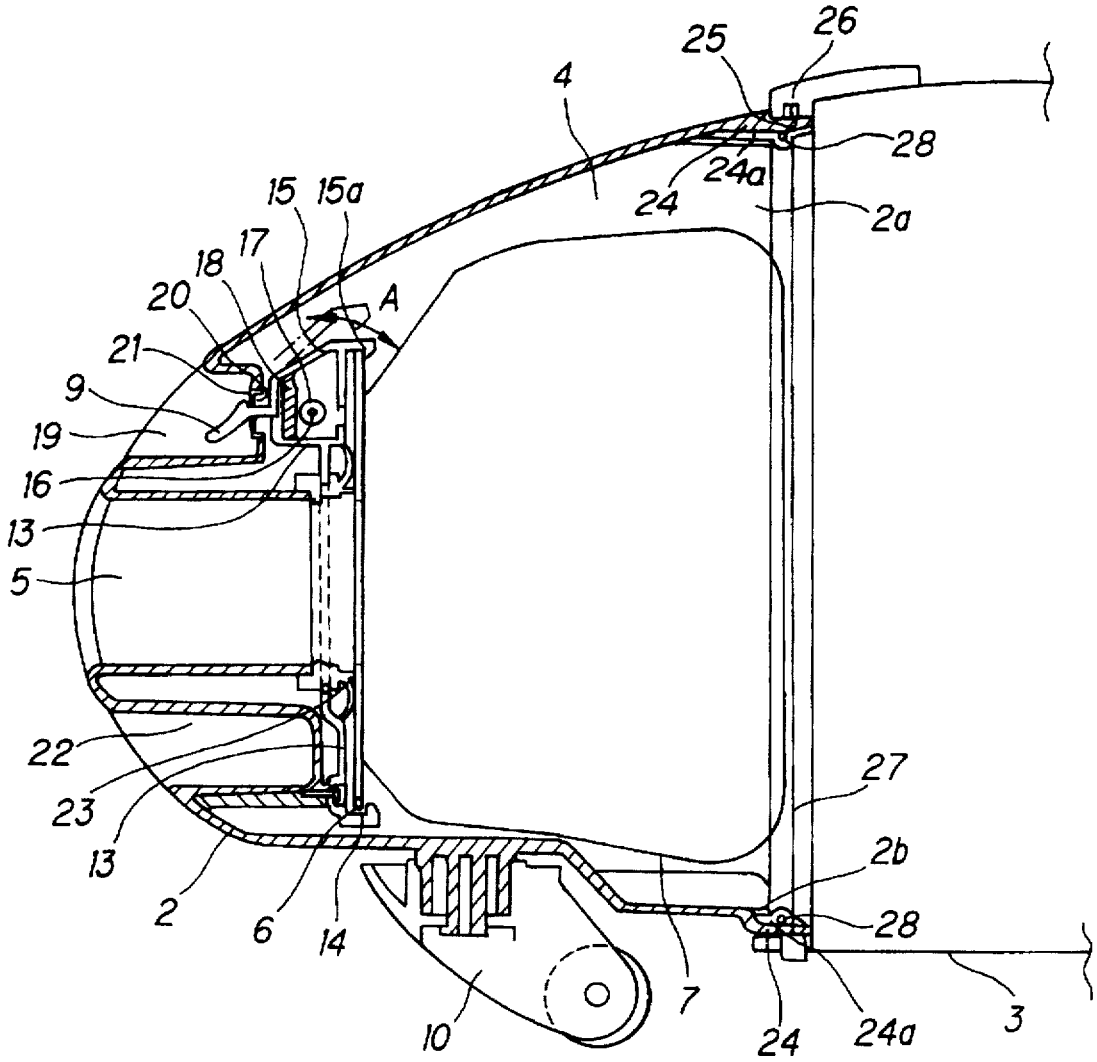
FIG. 8 is an enlarged sectional side view showing essential components on the dust collecting casing side of FIG. 7.

FIGS. 7 and 8 show an electric vacuum cleaner in accordance with a first embodiment of the present invention. In FIG. 7, an appliance housing 1 is formed of separable two components, that is, a dust collecting casing 2 and a motor casing 3. The dust collecting casing 2 is constructed so that the section of the casing 2 becomes gradually greater in width toward an opening 2*a* or the distal end of the casing 2 where the dust collecting casing 2 is to be joined to the motor casing 3.

The dust collecting casing 2 has a dust collecting chamber 4 where dust and dirt are collected therein. A connecting port 5 for connecting an unillustrated connecting hose is formed on the dust collecting case 2 on the opposite surface to the opening 2*a* in such a manner that the connecting port 5 is projected to the side of the dust collecting chamber 4. A dust collecting bag 7 having a rectangular (inclusive of square) attachment frame 6 is attached to the connecting port 5 on the side of the dust collecting chamber 4. A receiving portion 8 for receiving the attachment frame 6 is provided in the dust collecting chamber 4 in the vicinity of the connecting port 5, in order to fix the dust collecting bag 7. A releasing lever 9 for allowing an operator to release the engagement of the receiving portion 8 with the dust collecting bag 7 from the outside is integrally formed with the receiving portion 8. Provided beneath the dust collecting casing 2 is a roller portion 10 which is able to swivel its roller in conformity with the moving direction of the cleaner.

The aforementioned motor casing 3 incorporates an electric fan 11 therein for generating suction forces drawing dust and dirt etc., and is provided with a pair of wheels 12 on both sides in the lower part thereof.

FIG. 8 is an enlarged sectional side view showing the side of the dust collecting case 2. Referring to the figure, the dust collecting casing 2 will be described in detail. That is, the aforementioned receiving portion 8 is composed of: upper and lower dust collector attachment plates 13 disposed inside the dust collecting chamber 4 in the vicinity of the connecting port 5; a claw-shaped receiving piece 14 formed in the lower dust collector attachment plate 13 for receiving the lower side of the attachment frame 6; and a receiving clamp 15 with a claw 15*a* disposed in the upper dust collector attachment plate 13 for receiving the upper side of the attachment frame 6 to fix the dust collecting bag 7.

A pair of shafts 16 are formed opposed to each other on the receiving clamp 15 while a pair of supporting holes 17 are formed on the upper dust collector attachment plate 13 opposed to each other for supporting the shafts 16 to allow the receiving clamp 15 to rotate in the directions of arrows A in FIG. 8. Provided between the dust collector attachment plate 13 and the receiving clamp 15 is a spring 18 which urges the clamp 15 toward the clamping direction (the direction from a position of the receiving clamp 15 indicated by imaginary lines to the position indicated by solid lines).

A U-shaped (in the horizontal direction) depressed portion 19 recessed in parallel with the connecting port 5 toward the dust collecting chamber 4 is formed in the dust collecting casing 2 in a position over the connecting port 5. A via-hole 20 is formed in the depressed portion 19 to allow the releasing lever 9 integrally formed with the clamp 15 to come out therethrough while a clamp sealing 21 is provided on the periphery of the via-hole 20 in order to seal the gap between the releasing lever 9 and the via-hole 20.

Further, another U-shaped (in the horizontal direction) handgrip 22 recessed in parallel with the connecting port 5 toward the dust collecting chamber 4 is formed in the dust collecting casing 2 in a position under the connecting port 5. A seal packing 23 is provided in the periphery of the connecting port 5 on the side of the dust collecting chamber 4 in order to seal the gap among the connecting port 5, the dust collector attachment plate 13 and the attachment frame 6 to ensure hermetic confinement.

Further, the dust collecting casing 2 has a stepped portion 24 enclosing an opening rim 2*b* of the dust collecting casing 2 from the outside. A groove 25 is cut out on the outside surface of an opening rim 24*a* on the upper part of the stepped portion 24 while a fitting projection 26 for mating the groove 25 is disposed on the outside rim on the upper part of the motor casing 3. Further, a projected joining portion 27 for making a joint between the dust collecting casing 2 and the motor casing 3 is formed on the side of the motor casing 3.

A seal packing 28 for hermetically sealing the jointing face between the dust collecting casing 2 and the motor casing 3 is provided so as not to project inward of the inner face of the opening rim 2*b* of the dust collecting casing 2 on the whole circumference of the stepped portion 24. This seal packing 28 is configured so as to be nipped between the opening rim 2*b* of the dust collecting casing 2 and the joining portion 27 of the motor casing 3 when the dust collecting casing 2 and the motor casing 3 are put together.

Referring now to FIG. 8, the operation of replacing the dust collecting bag will be described in the electric vacuum cleaner thus configured in accordance with the first embodiment of the present invention.

In replacing the dust collecting bag 7, the operator should initially separate the appliance housing 1 into the dust collecting casing 2 and the motor casing 3. When holding the handgrip 22 of the dust collecting casing 2 so that the opening 2*a* thereof is down, the operator should push the releasing lever 9 downward. This operation causes the clamp 15 to disengage the engaged state between the claw 15*a* and the upper side of the attachment frame 6. Thereby the receiving clamp 15 is moved, as shown in FIG. 8, from the position indicated by the solid lines to the position shown by the broken lines, against the urging force of the spring 18.

When the engaged state between the claw 15*a* of the clamp 15 and the upper side of the attachment frame 6 is canceled, the dust collecting bag 7 falls through the opening 2*a* of the dust collecting casing 2 end slides along the inner wall of the dust collecting casing 2, whereby the dust collecting bag 7 is taken out.

After the dust collecting bag 7 is detached, the operator should insert a new dust collecting bag 7 through the opening 2*a* of the dust collecting case 2 to put the underside of the attachment frame 6 onto the catching piece 14. Then, the clamp 15 should be moved from the position indicated by the broken lines to the position indicated by the solid lines in FIG. 8, so as to cause the claw 15*a* of the clamp 15 to engage with the upper side of the attachment frame 6, whereby the dust collecting bag 7 is fixed.

In the configuration of the first embodiment as described heretofore, the replacement of the dust collecting bag 7 can be done by decomposing the appliance housing 1 into the dust collecting casing 2 and the motor casing 3; and releasing, by pushing the releasing lever 9, the engaged state between the claw 15*a* of the clamp 15 and the upper side of the attachment frame 6, whereby it is possible for the operator to remove the dust collecting bag 7 easily in the single-step operation without requiring any troublesome handling for the replacement of the dust collecting bag 7.

Since the dust collecting casing 2 is formed so that the section of the casing 2 becomes gradually greater in width toward the opening 2*a* of the casing 2; when the appliance housing 1 is separated into the dust collecting casing 2 and the motor casing 3 thereafter the releasing lever 9 is freed with the opening 2*a* of the dust collecting casing 2 down, it is possible to take the dust collecting bag 7 out by allowing the bag 7 not to be caught between the inner walls of the dust collecting casing 2 but to slide down smoothly.

Further, since the stepped portion 24 is provided so that the seal packing 28 will not project inward of the inner surface of the dust collecting casing 2; when the dust collecting bag 7 is taken out by sliding it down, the dust collecting bag 7 can be removed smoothly without being caught by the seal packing 28. Since the seal packing 28 is formed so as to be sandwiched between the front edge of the opening rim 2*b* of the dust collecting casing 2 and the front face of the jointing portion 27 of the motor casing 3; when the dust collecting casing 2 and the motor casing 3 are joined or separated, the seal packing 28 will never obstruct, whereby it is possible to make a perfectly hermetic state on the jointing surface between the dust collecting casing 2 and the motor casing 3.

Although the above description of the first embodiment has been made on the case of the electric vacuum cleaner in which the appliance housing 1 can be separated into the dust collecting casing 2 and the motor casing 3, it is also possible to construct an effective configuration by only providing a releasing lever 9 of the first embodiment for a conventional electric vacuum cleaner with a lidding member which can be opened and closed when the dust collecting bag is to be replaced. That is, the present invention should not be limited only to the above configuration of the first embodiment.

Figure 9:
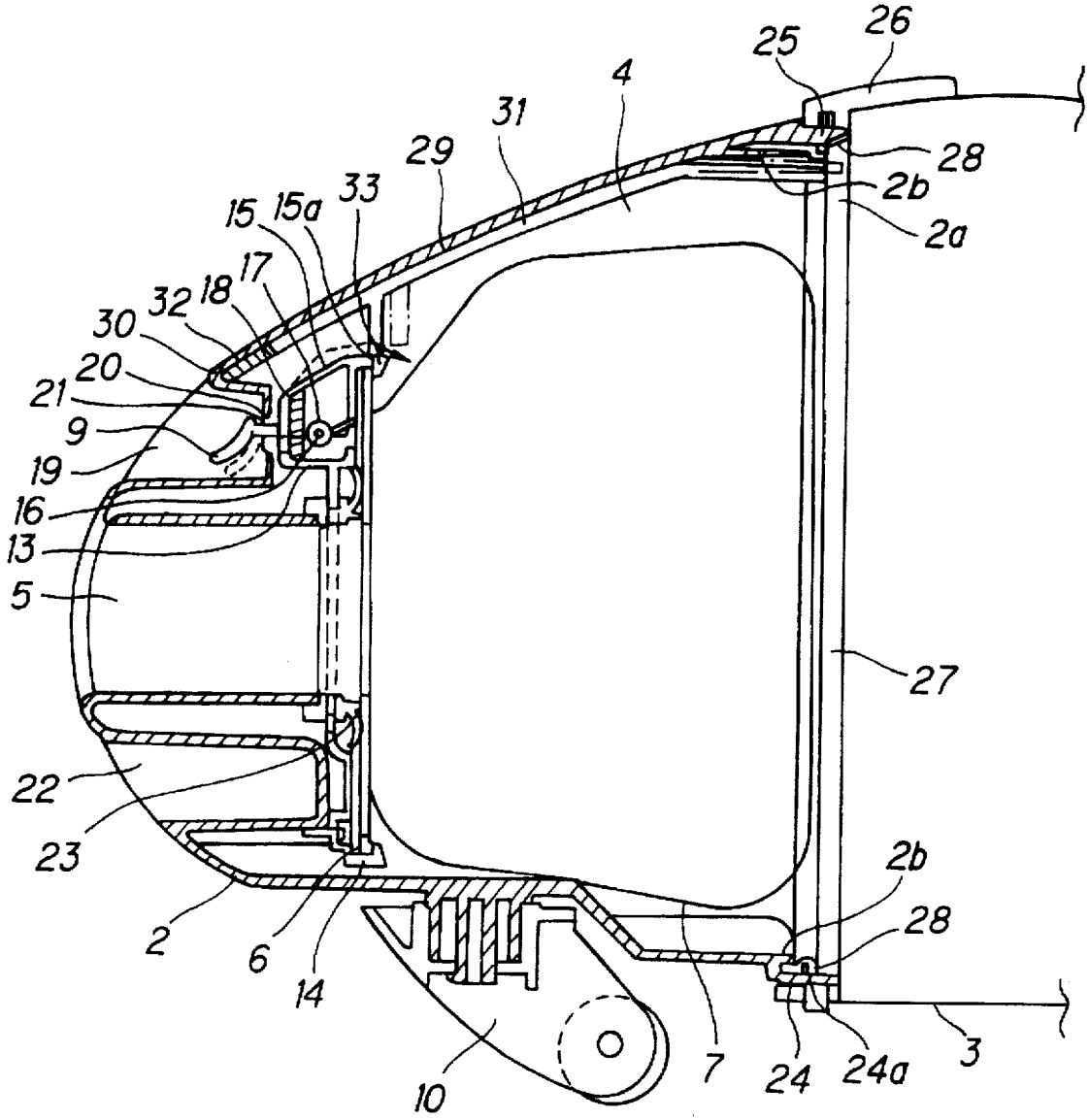
FIG. 9 is a sectional side view showing essential components of a second embodiment of an electric vacuum cleaner of the present invention.

FIG. 9 shows a second embodiment of an electric vacuum cleaner of the present invention.

In this embodiment, the same components with those in the first embodiment will be allotted with the same reference numerals and description of constructions and operations for those components is omitted.

In FIG. 9, the electric vacuum cleaner of this embodiment further includes, in addition to the configuration of the first embodiment, an interlocking device 29 disposed on the upper inner surface of the dust collecting casing 2 for preventing the releasing movement of the releasing lever 9 when the dust collecting casing 2 and the motor casing 3 are joined.

The interlocking device 29 is composed of an interlocking plate 31 disposed along the inner surface of the dust collecting casing 2 from the upper part of the opening rim **2*b* to the upper part of a bending portion 30, a spring 32 and a blocking projection 33 integrally formed with the interlocking plate 31. The interlocking plate 31 is formed slightly shorter than the length between the upper portion of the opening rim 2*b* and the upper portion of the bending portion 30 while the spring 32 is disposed between the bending portion 30 and one end of the interlocking plate 31 on the side of the bending portion 30 so as to urge the plate 31 toward the opening rim. When the dust collecting casing 2 and the motor casing 3 are joined, the blocking projection 33 is positioned on the top of the claw 15*a* of the clamp 15 as shown in FIG. 9 so as to prevent the releasing lever 9 from being operated. When the dust collecting casing 2 and the motor casing 3 are separated from one another, the interlocking plate 31 which was pressed by the jointing portion 27 of the motor casing 3 is urged by the aforementioned spring 32 from the position indicated by solid lines to the position indicated by broken lines in FIG. 9, so that the blocking plate 33 will not occupy the upper space of the clamp 15, thus allowing the releasing lever 9** to free the clamp.

In the configuration of the second embodiment as described heretofore, when the dust collecting casing 2 and the motor casing 3 are joined, the blocking projection 33 prevents the clamp 15 from moving in the releasing direction to thereby prevent disengaement from the engaged state between the claw **15*a* of the clamp 15 and the upper side of the attachment frame 6. In consequence, the dust collecting bag 7 will not get out of place unexpectedly during cleaning. Thus, it is possible to prevent the appliance from breaking due to the pollution of dust and dirt inside the appliance which would be caused by unexpected disengagement of the dust collecting bag 7**.

When the appliance housing 1 is decomposed into the dust collecting casing 2 and the motor casing 3, the interlocking plate 31 which was pressed by the jointing portion 27 of the motor casing 3 is urged by the aforementioned spring 32 from the position indicated by solid lines to the position indicated by broken lines in FIG. 9. In consequence, the blocking plate 33 allows the cancellation of the engaged state between the claw **15*a* of the clamp 15 and the upper side of the attachment frame 6. Accordingly, it is possible to take out the dust collecting bag 7 for replacement when the releasing lever 9** is freed by the operator.

FIGS. 10 through 14 show a configuration of a third embodiment of an electric vacuum cleaner of the present invention.

In this embodiment, the same components with those in the second embodiment will be allotted with the same reference numerals and description of constructions and operations for those components is omitted.

Figure 10:
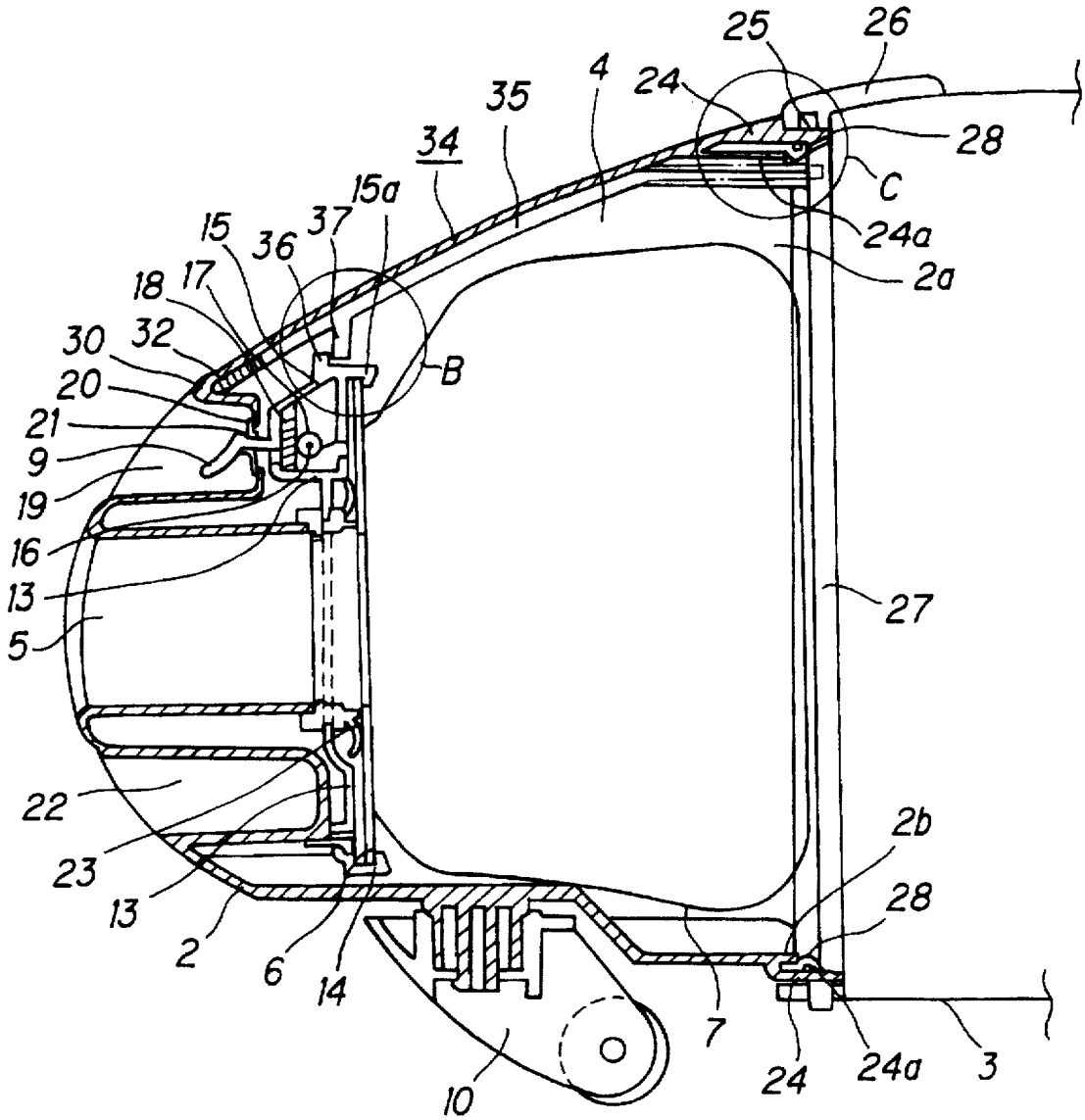
FIG. 10 is a sectional side view showing essential components of a third embodiment of an electric vacuum cleaner of the present invention.

In FIG. 10, the electric vacuum cleaner of this embodiment has, in place of the interlocking device 29 of the above second embodiment, a jointing state-prohibiting device (or operation-disabling device) 34 disposed on the upper inner surface of the dust collecting casing 2 for prohibiting the dust collecting casing 2 from joining with the motor casing 3 when no dust collecting bag 7 is engaged in the catching device 8.

The jointing state-prohibiting device (or operation-disabling device) 34 is composed of a blocking plate 35 disposed along the inner surface of the dust collecting casing 2 from the upper part of the opening rim **2*b* to the upper part of a bending portion 30, a spring 32 and an engaging projection 37 integrally formed with the blocking plate 35. This blocking plate 35 is formed slightly shorter than the length between the upper portion of the opening rim 2*b* and the upper portion of the bending portion 30**.

Provided on top of the clamp 15 is an engaging projection 36 which engages the aforementioned engaging projection 37 of the blocking plate 35. In this arrangement, when the dust collecting casing 2 is joined to the motor casing 3 with the dust collecting bag 7 attached, the engaging projections 36 and 37 engage with one another. On the other hand, when the dust collecting casing 2 is tried to be joined to the motor casing 3 with no dust collecting bag 7 attached, the upper end of the engaging projection 36 hooks the engaging projection 37, so that one end of the blocking plate 35 is projected out from the opening rim **24*a* of the stepped portion 24, to thereby prohibit the joining between the dust collecting casing 2 and the motor casing 3**.

Figure 11:
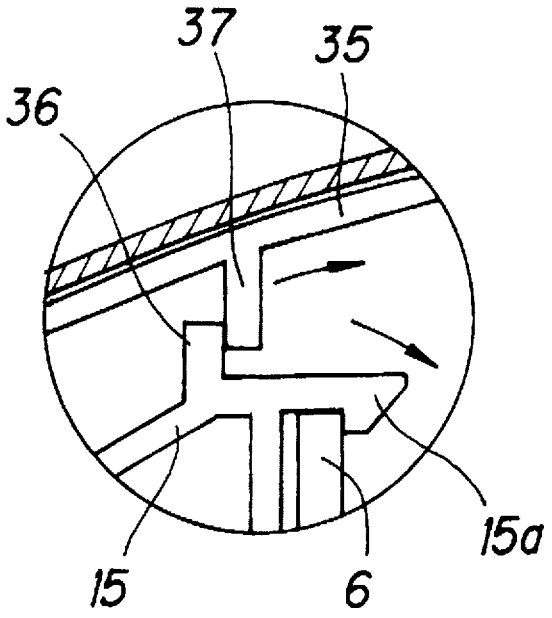
FIG. 11 is an enlarged view showing components indicated by a circle B in FIG. 10.
Figure 12:
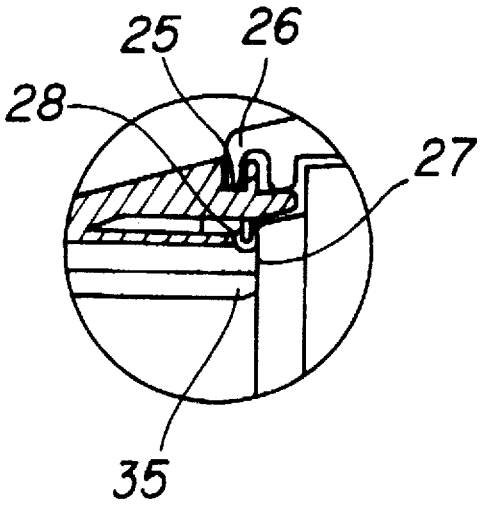
FIG. 12 is an enlarged view showing components indicated by a circle C in FIG. 10.

In the configuration of the third embodiment as described heretofore, when the dust collecting casing 2 is being joined to the motor casing 3 with the dust collecting bag 7 attached, the engaging projections 36 and 37, indicated by a circle B in FIG. 10, engage with one another as shown in FIG. 11, to thereby form a clearance between the engaging projection 37 and the clamp 15. In this situation, the groove portion 25 and the fitting portion 26, indicated by a circle C in FIG. 10, mate each other as shown in FIG. 12.

Figure 13:
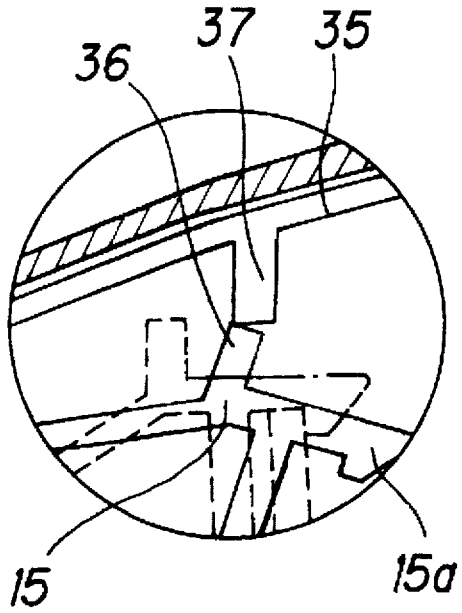
FIG. 13 is an enlarged view showing a state of components indicated by the circle B in FIG. 10 where a dust collecting bag is taken out from an appliance housing decomposed.
Figure 14:
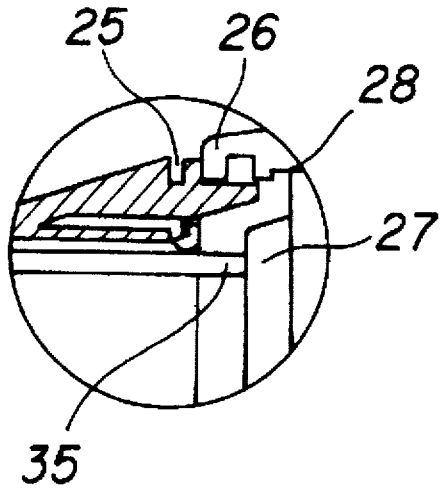
FIG. 14 is an enlarged view showing a state of components indicated by the circle C in FIG. 10 where a dust collecting bag is taken out from an appliance housing decomposed.

When the dust collecting casing 2 is tried to be joined to the motor casing 3 with the dust collecting bag 7 not attached, the end of the blocking plate 35 projects out from the opening rim **24*a* at the stepped portion 24 of the dust collecting casing 2 and therefore is pressed by the jointing portion 27. At this moment, the upper end of the engaging projection 36 and the engaging projection 37, indicated by the circle B in FIG. 10, interfere with each other as shown in FIG. 13. Accordingly, in the portion indicated by the circle C in FIG. 10, the blocking plate 35 becomes such an obstacle as to prohibit the engagement between the groove portion 25 and the fitting portion 26 as shown in FIG. 14**, to thereby prohibit the joining between the dust collecting casing 2 and the motor casing 3. In consequence, it is possible to prevent the operator from forgetting to attach the dust collecting bag 7, whereby it is possible to prevent the appliance from being broken by the pollution of dust and dirt etc., inside the appliance housing 1 which would be caused by the default of attaching the dust collecting bag 7.

Since the positional relation between the engaging projections 36 and 37 in the third embodiment depend upon the dimensions of the engaging projections 36 and 37, it should not be limited to the above-stated configuration.

Figure 15:
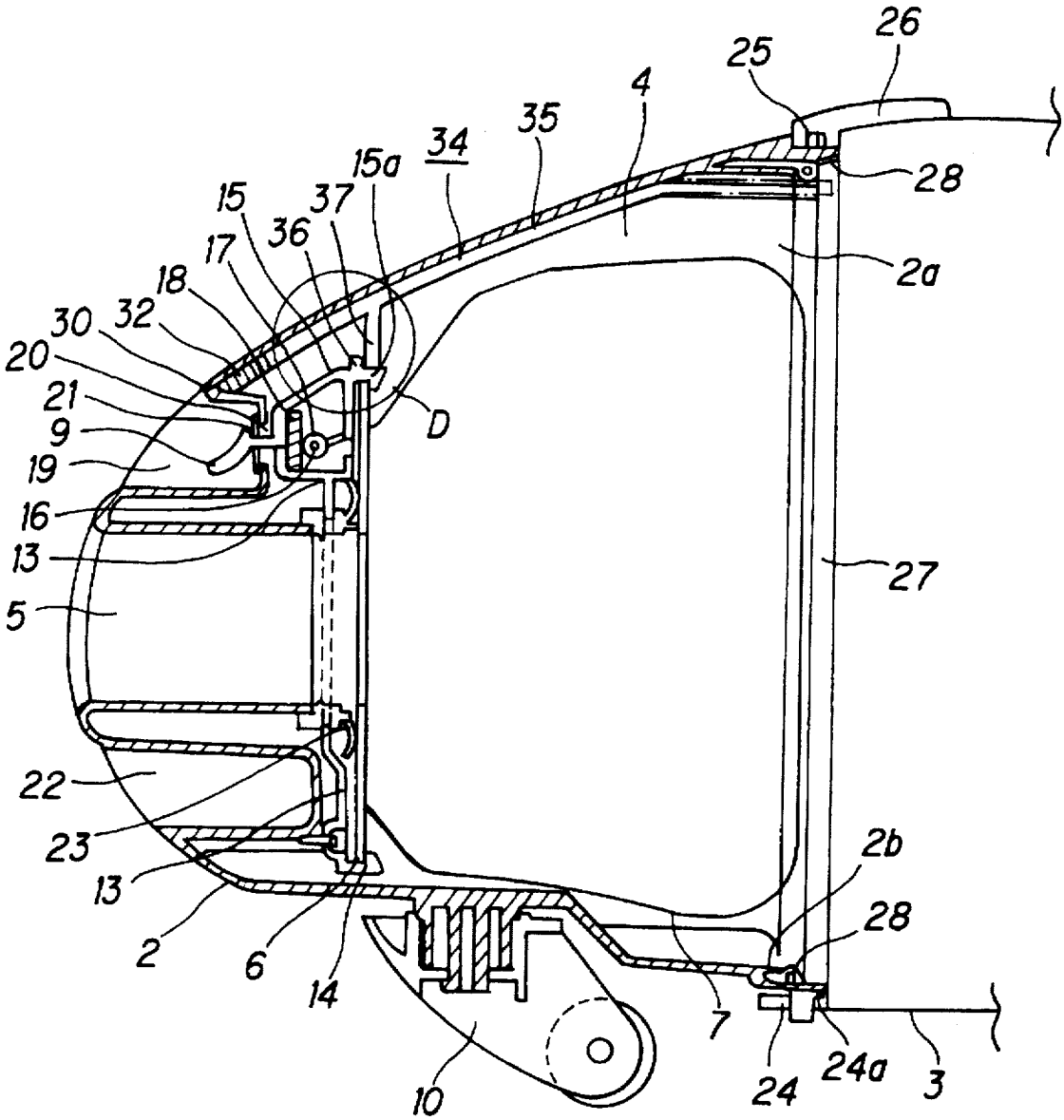
FIG. 15 is a sectional side view showing essential components of a fourth embodiment of an electric vacuum cleaner of the present invention.
Figure 16:
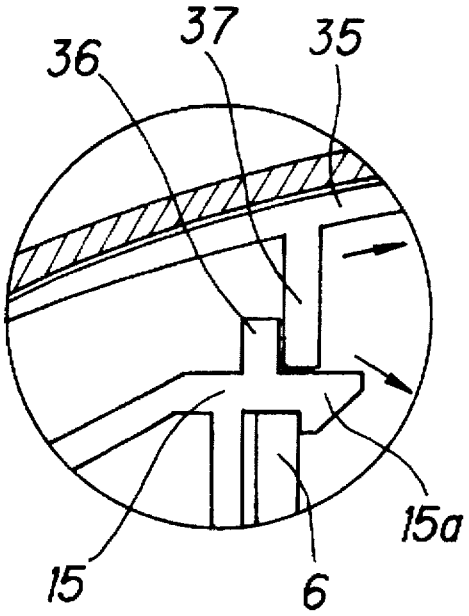
FIG. 16 is an enlarged view showing components indicated by a circle D in FIG. 15.
Figure 17:
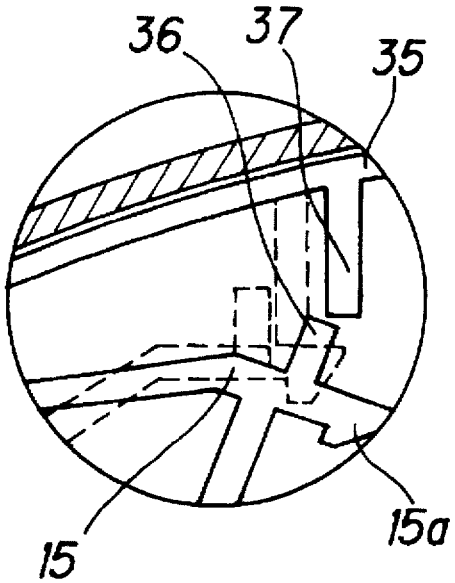
FIG. 17 is an enlarged view showing a state of components indicated by the circle D in FIG. 15 where a dust collecting bag is taken out from an appliance housing decomposed.

FIGS. 15 through 17 show a configuration of an electric vacuum cleaner in accordance with a fourth embodiment of the present invention.

In the description of this embodiment, the same components with those in the third embodiment will be allotted with the same reference numerals, therefore the description of the configurations and effects for those parts is omitted.

As seen in FIG. 15, different features of this embodiment from the third embodiment are the dimensions and forming positions of the engagement projections 36 and 37. As to the dimensions, the engaging projection 36 is formed to be short while the engaging projection 37 is formed to be long for compensating the shortness of the engaging projection 36. The engaging projection 37 is formed in such a length that the distal end of the projection 37 comes into contact with the top surface of the clamp 15 when the dust collecting casing 2 is joined to the motor casing 3 with the dust collecting bag 7 attached.

With regard to the forming position of the engaging projection 36, the engaging projection 36 is formed nearer to the claw 15*a* on the top surface of the clamp 15. On the other hand, the engaging projection 37 is formed in such a position that the engaging projections 36 and 37 engage each other and little clearance is produced between the distal end of the engaging projection 37 and the top surface of the clamp 15 when the dust collecting casing 2 is joined to the motor casing 3 with the dust collecting bag 7 attached; and when the dust collecting casing 2 is tried to be joined to the motor casing 3 with the dust collecting bag 7 removed, the upper end of the engaging projection 36 hooks the engaging projection 37 so as to cause one end of the blocking plate 35 to project out of the opening rim 24*a* of the stepped portion 24 of the dust collecting casing 2, to thereby prohibit the joining between the dust collecting casing 2 and the motor casing 3.

In the configuration of the fourth embodiment as described heretofore, when the dust collecting casing 2 is being jointed to the motor casing 3 with the dust collecting bag 7 attached, the engaging projections 36 and 37, indicated by a circle D in FIG. 15, engage with one another as shown in FIG. 16, to thereby yield a state in which little clearance is formed between the distal end of the engaging projection 37 and the top surface of the clamp 15. In consequence, the same effect as in the second embodiment can be attained.

In a case where the appliance housing i is separated into the dust collecting casing 2 and the motor casing 3 while the dust collecting bag 7 is detached by operating the releasing lever 9, the clamp 15 and the engaging projection 37 indicated by broken lines in FIG. 17 move to positions indicated by solid lines in FIG. 17, thus bringing a situation in which the distal end of the engaging projection 36 hooks the engaging projection 37. In consequence, the same effect as in the third embodiment can be attained.

Further, since this embodiment is able to achieve the operations and effects of both the second and third embodiments without needing increased number of parts, it is possible to simplify the interior structure of the dust collecting casing 2, resulting in reduced cost.

Next, a fifth embodiment of an electric vacuum cleaner of the present invention will be described with reference to FIGS. 18 through 30.

Figure 18:
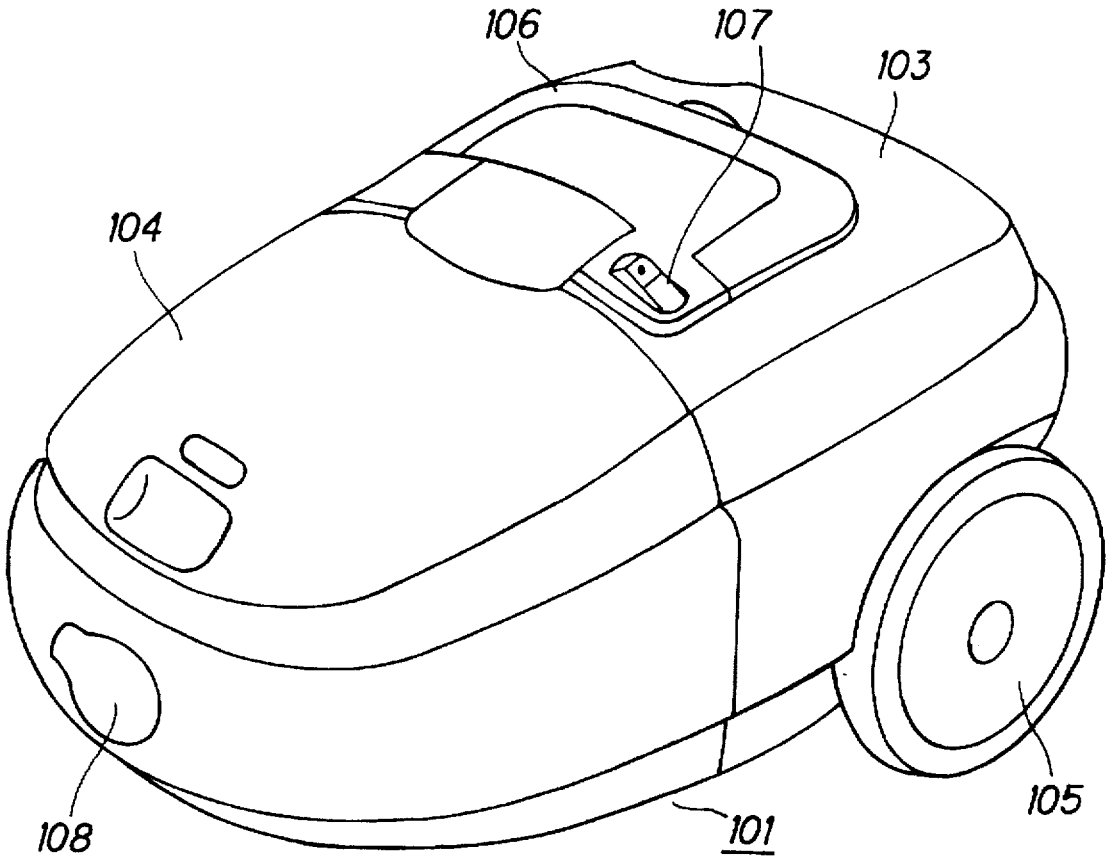
FIG. 18 is a perspective view showing a fifth embodiment of an electric vacuum cleaner of the present invention.
Figure 19:
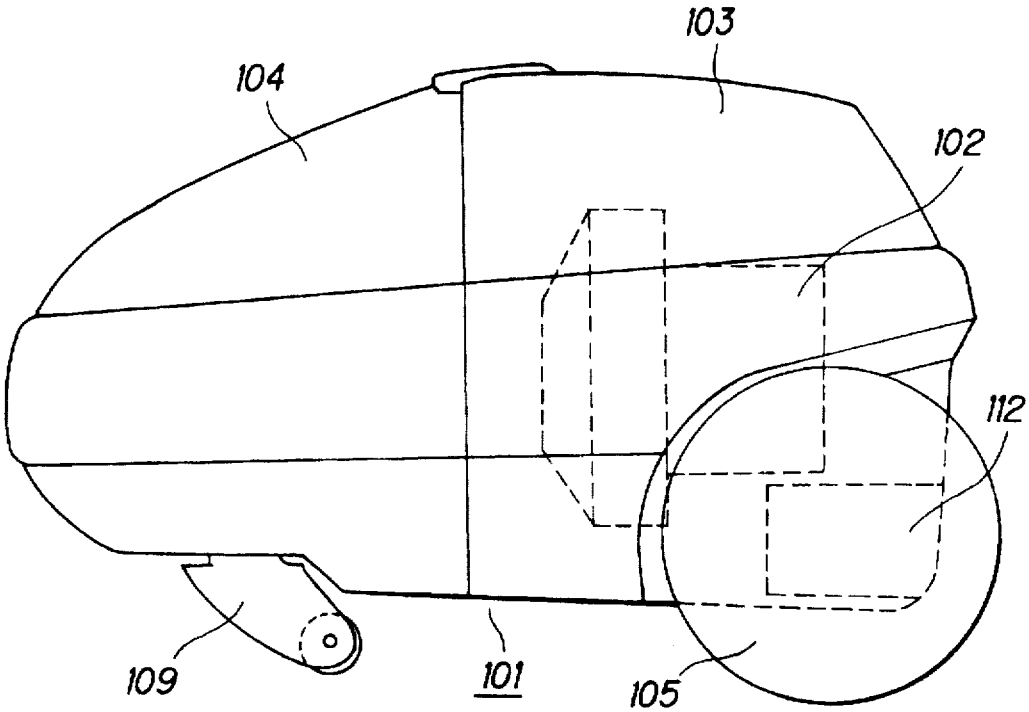
FIG. 19 is a side view of FIG. 18.

FIGS. 18 and 19 are perspective and side views, respectively, of an electric vacuum cleaner of the present invention. As seen in the figures, the basic configuration of the cleaner includes: a cleaner appliance body 101 composed of a rear body 103 having an electric fan 102 therein and a forward body 104 having a dust collecting chamber (not shown); a pair of wheels 105 disposed on both sides of the rear body 103; a handgrip 106 and a power switch 107, both disposed on the top surface of the rear body 103; a connecting port 108 disposed in the front part on the front face of the forward body 104 for connecting an extension hose (not shown) and an extension tube (not shown) and a free wheel 109 attached beneath the bottom surface of the forward body 104.

Provided for the rear body 103 on the lower backside is a depressed storage portion 112 for storing accessory suction nozzles such as a brush-equipped suction nozzle 110 and a gap-cleaning suction nozzle 111 fitted therein.

Figure 20:
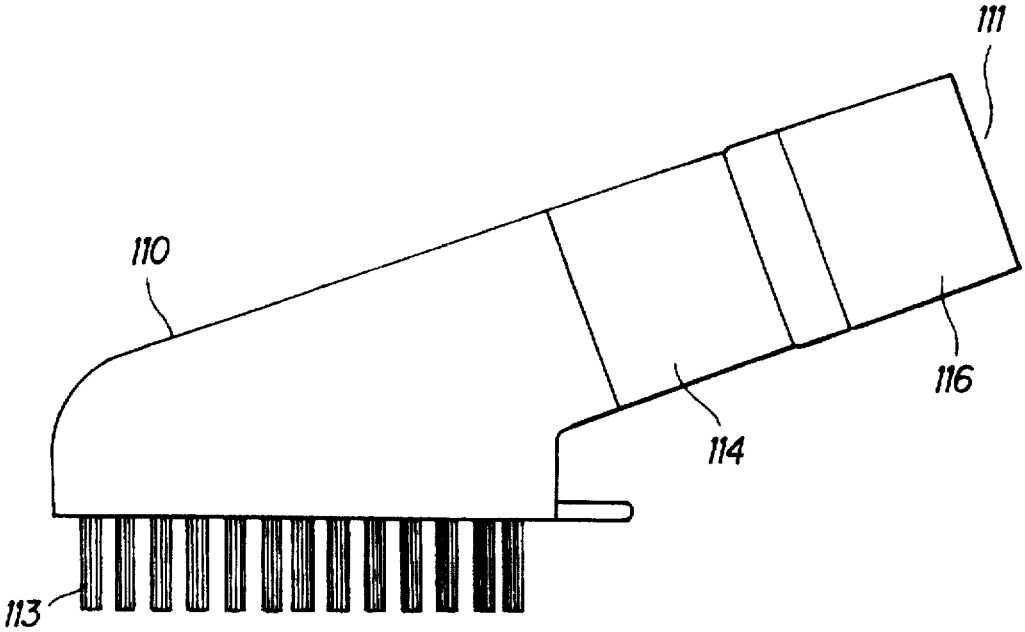
FIG. 20 is a side view showing a state where a gap-cleaning suction nozzle is inserted into a brush-equipped suction nozzle in the electric vacuum cleaner in accordance with the fifth embodiment of the present invention.
Figure 21:
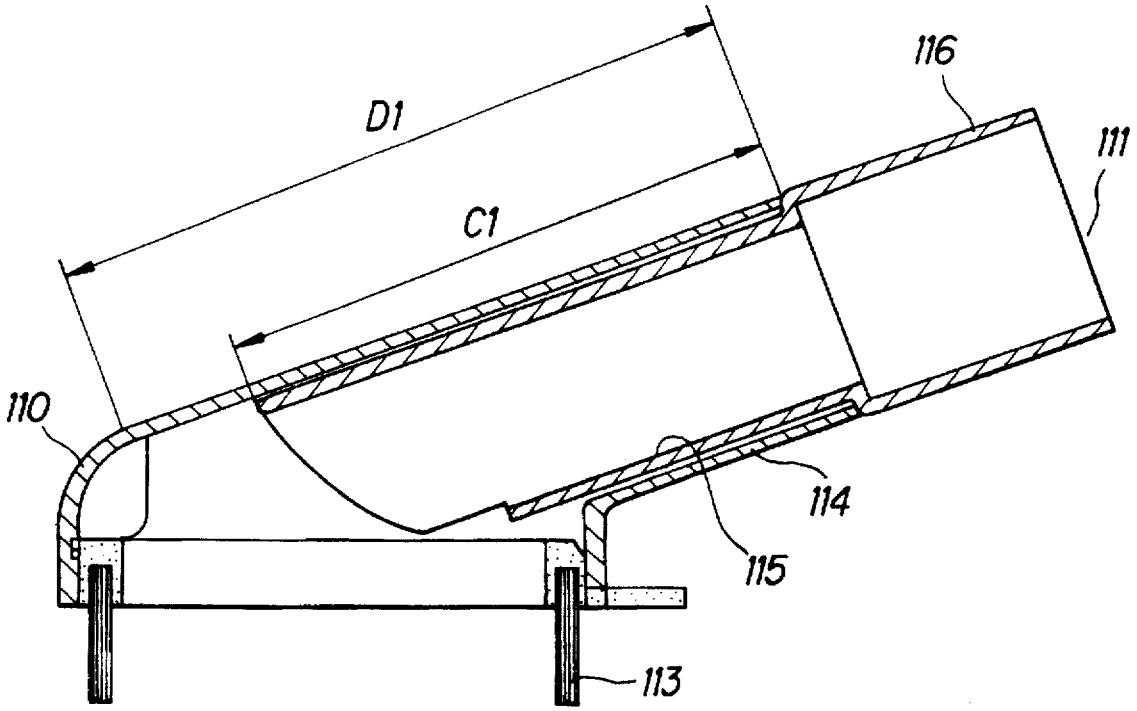
FIG. 21 is a sectional view of FIG. 20.
Figure 22:
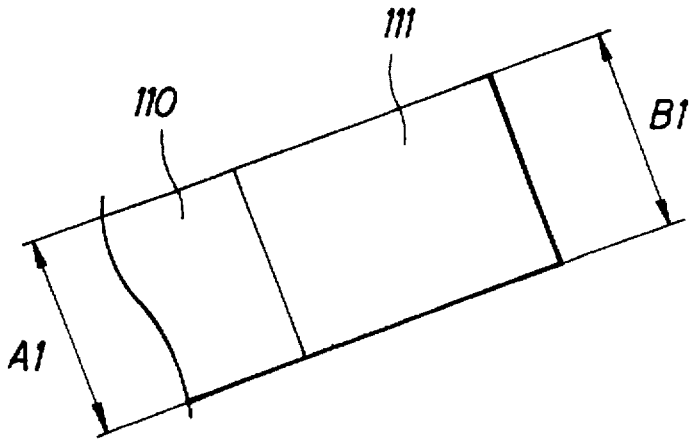
FIG. 22 is a partial plan view of FIG. 20.

As shown in FIGS. 20 through 22, the aforementioned brush-equipped suction nozzle 110 is composed of a front part provided with bristles 113 and a rear part having a fitting portion 114.

The aforementioned gap-cleaning suction nozzle 111 is composed of an elongate nozzle portion 115 for cleaning gaps between articles of furniture and the like and a fitting portion 116 on the rear side of the nozzle portion 115.

The fitting portion 114 of the brush-equipped suction nozzle 110 has an outside diameter of $A_1$ whereas the fitting portion 116 of the gap-cleaning suction nozzle 111 has an outside diameter of $B_1$. Here, these two elements 114 and 116 are formed so as to have an identical dimension ($A_1 = B_1$). Therefore, when the nozzle portion 115 of the gap-cleaning suction nozzle 111 is inserted into the brush-equipped suction nozzle 110, the fitting portion 116 of the gap-cleaning suction nozzle 111 abuts the rear brim of the fitting portion 114 of the brush-equipped suction nozzle, so that the insertion of the gap-cleaning suction nozzle 111 into the brush-equipped suction nozzle 110 is restrained.

The front end of the nozzle portion 115 of the gap-cleaning suction nozzle 110 is formed to be inclined in order to easily clean narrow areas. A length $C_1$ from the frontmost position of the nozzle portion 115 to the boundary to the fitting portion 116 is set up so as not to abut the interior surface of the brush-equipped suction nozzle 110 when the nozzle portion 115 is inserted into the brush-equipped suction nozzle 110. In other words, the length $C_1$ is set up to be smaller than a length $D_1$ of the upper linear portion of the brush-equipped suction nozzle 110.

By thus setting up the length of the nozzle portion 115, it is possible to insert the gap-cleaning suction nozzle 111 into the brush-equipped suction nozzle 110, even if the nozzle portion 115 is inserted into the brush-equipped suction nozzle 110 with its frontmost part directed to any direction (regardless of the frontmost part of the nozzle portion 115 turned right or left or up or down).

Figure 23:
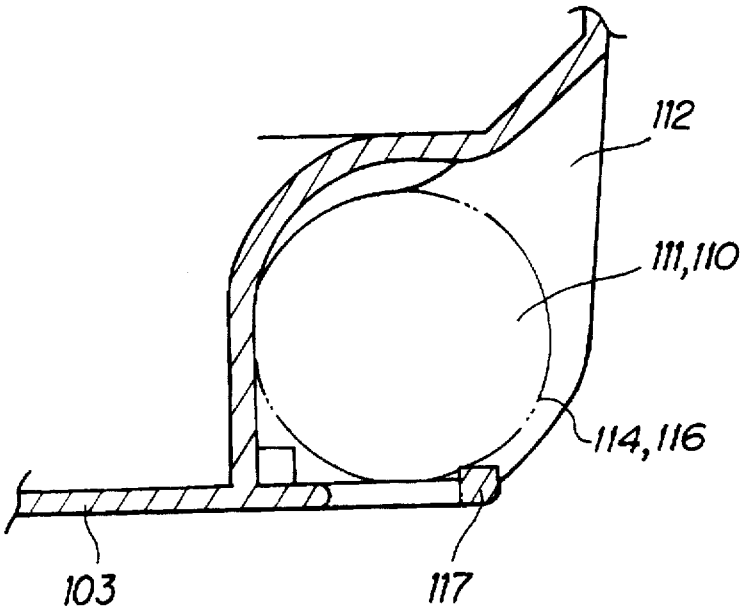
FIG. 23 is a sectional view showing a part of a depressed storage portion in the electric vacuum cleaner in accordance with the fifth embodiment of the present invention.
Figure 24:
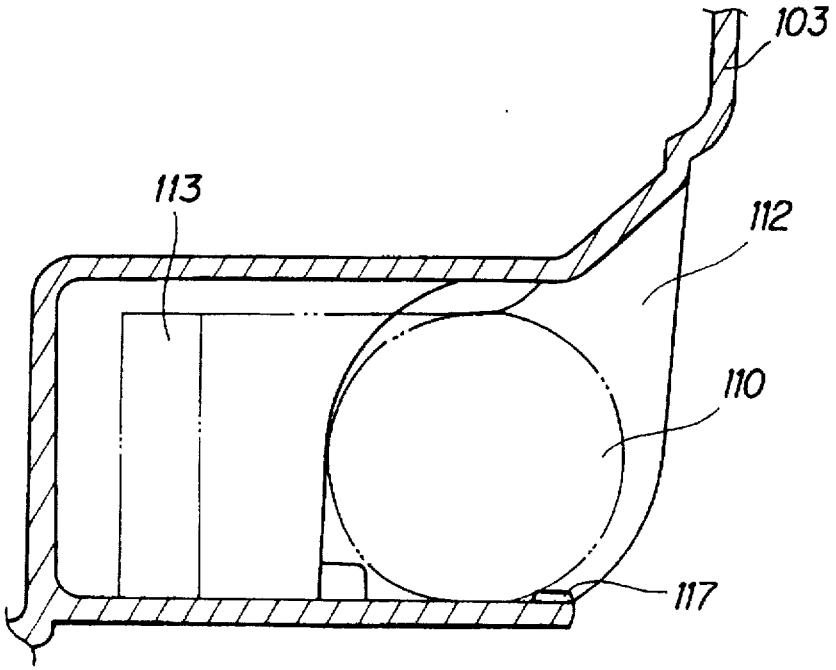
FIG. 24 is a sectional view showing another part of a depressed storage portion in the electric vacuum cleaner in accordance with the fifth embodiment of the present invention.

The depressed storage portion 112 of the rear body 103, as shown in FIGS. 23 and 24, is formed so as to be able to accommodate the integrally fitted parts or the brush-equipped suction nozzle 110 with the gap-cleaning suction nozzle 111 inserted therein (the state shown in FIG. 20).

More specifically, the depressed storage portion 112 is constructed so that the depressed portion shown in FIG. 24 for accommodating the front part with bristles 113 of the brush-equipped suction nozzle 110 is deeper than the depressed portion shown in FIG. 23 for receiving the fitting portion 114 of the brush-equipped suction nozzle 110 and the fitting portion 116 of the gap-cleaning suction nozzle 111.

A fitting rib 117 for snap fitting the fitting portion 114 of the brush-equipped suction nozzle 110 and the fitting portion 116 of the gap-cleaning suction nozzle 111 is provided, as shown in FIG. 23, along the side end on the underside of the depressed storage portion 112.

The operation of the thus configurated electric vacuum cleaner will be described.

Figure 25:
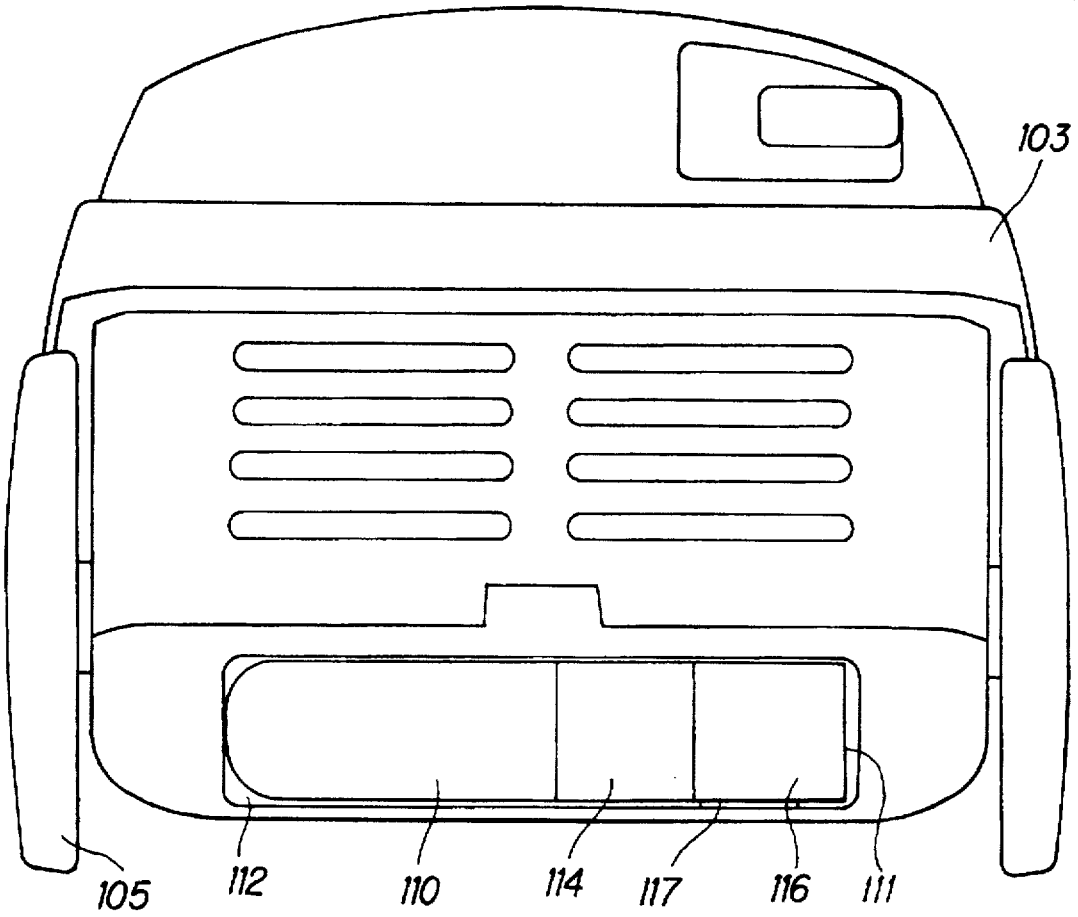
FIG. 25 is a backside view showing a state where both brush-equipped and gap-cleaning suction nozzles are fitted in the depressed storage portion in the electric vacuum cleaner in accordance with the fifth embodiment of the present invention.
Figure 26:
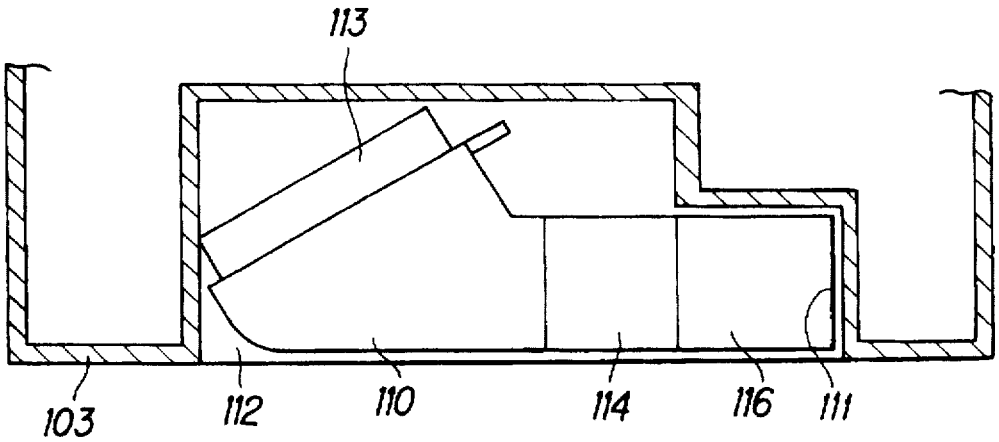
FIG. 26 is a sectional view of the depressed storage portion shown in FIG. 25.

Initially, the storage of the brush-equipped suction nozzle 110 and the gap-cleaning suction nozzle 111 into the depressed storage portion 112 is done by fitting the nozzle portion 115 of the gap-cleaning suction nozzle 111 into the brush-equipped suction nozzle 110; and fitting the thus integrated brush-equipped suction nozzle 110 with the gap-cleaning suction nozzle 111 therein, into the depressed storage portion 112, as shown in FIGS. 25 and 26. At this moment, the fitting portion 116 of the gap-cleaning suction nozzle 111 is snap fitted by the fitting rib 117 of the depressed storage portion 112, whereby the brush-equipped suction nozzle 110 and the gap-cleaning nozzle 111 are accommodated together.

Figure 27:
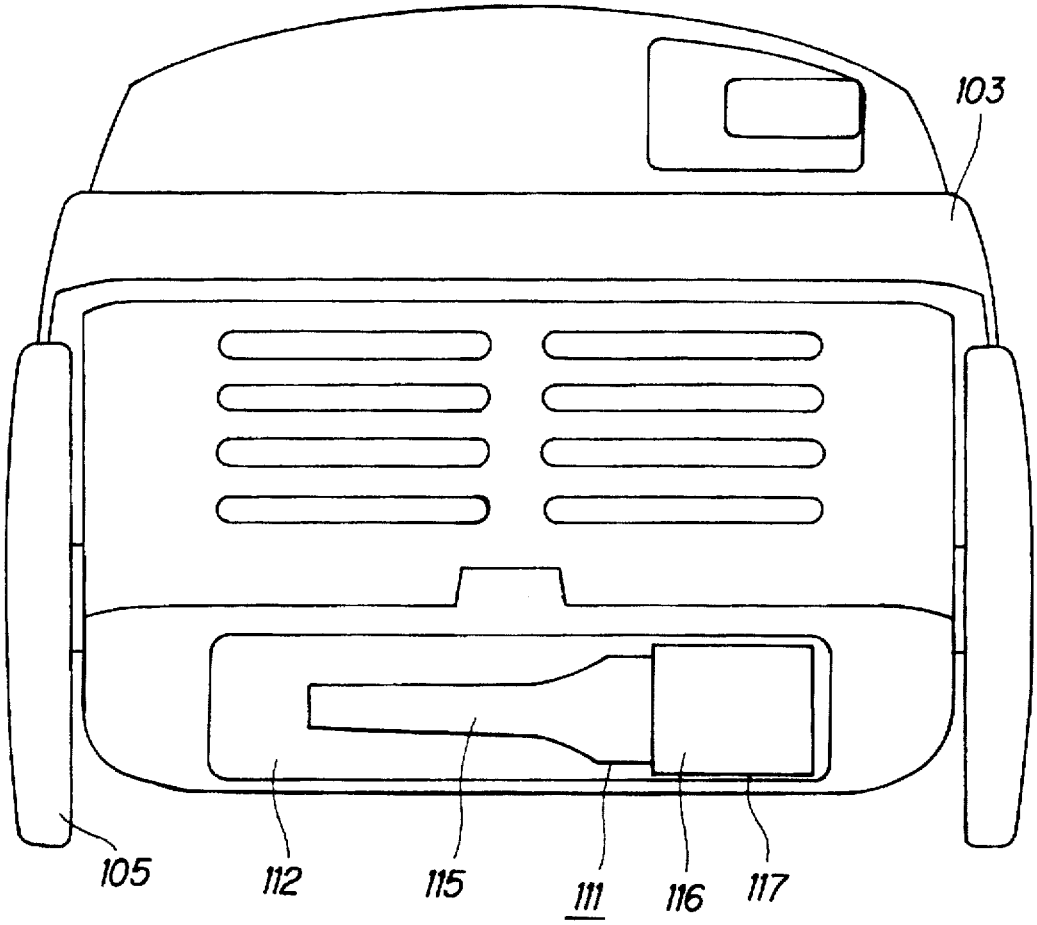
FIG. 27 is a backside view showing a state where only the gap-cleaning suction nozzle is fitted in the depressed storage portion in the electric vacuum cleaner in accordance the fifth embodiment of the present invention.
Figure 28:
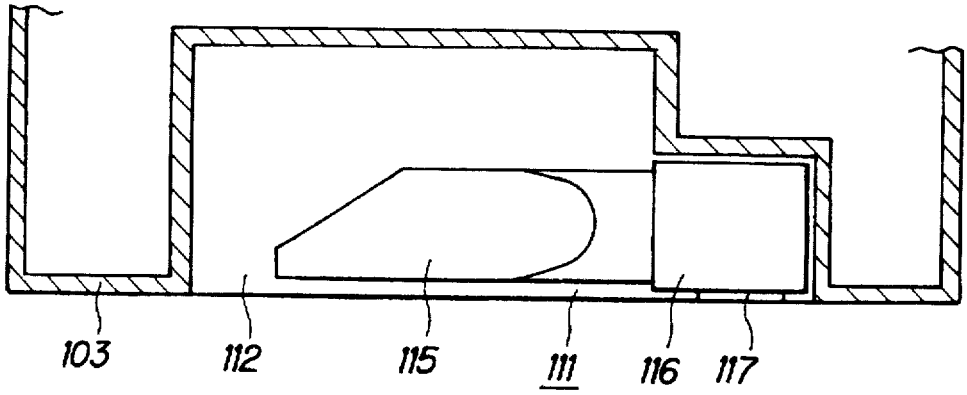
FIG. 28 is a sectional view of the depressed storage portion shown in FIG. 27.

Next, in a case where the gap-cleaning suction nozzle 111 is accommodated into the depressed storage portion 112 while the brush-equipped suction nozzle 110 is being used, when the gap-cleaning suction nozzle 111 is inserted in the depressed storage portion 112, the fitting portion 116 of the gap-cleaning suction nozzle 111 is snap fitted by the fitting rib 117 of the depressed storage portion 112, whereby only the gap-cleaning suction nozzle 111 is stored in the depressed storage portion 112, as shown in FIGS. 27 and 28.

Figure 29:
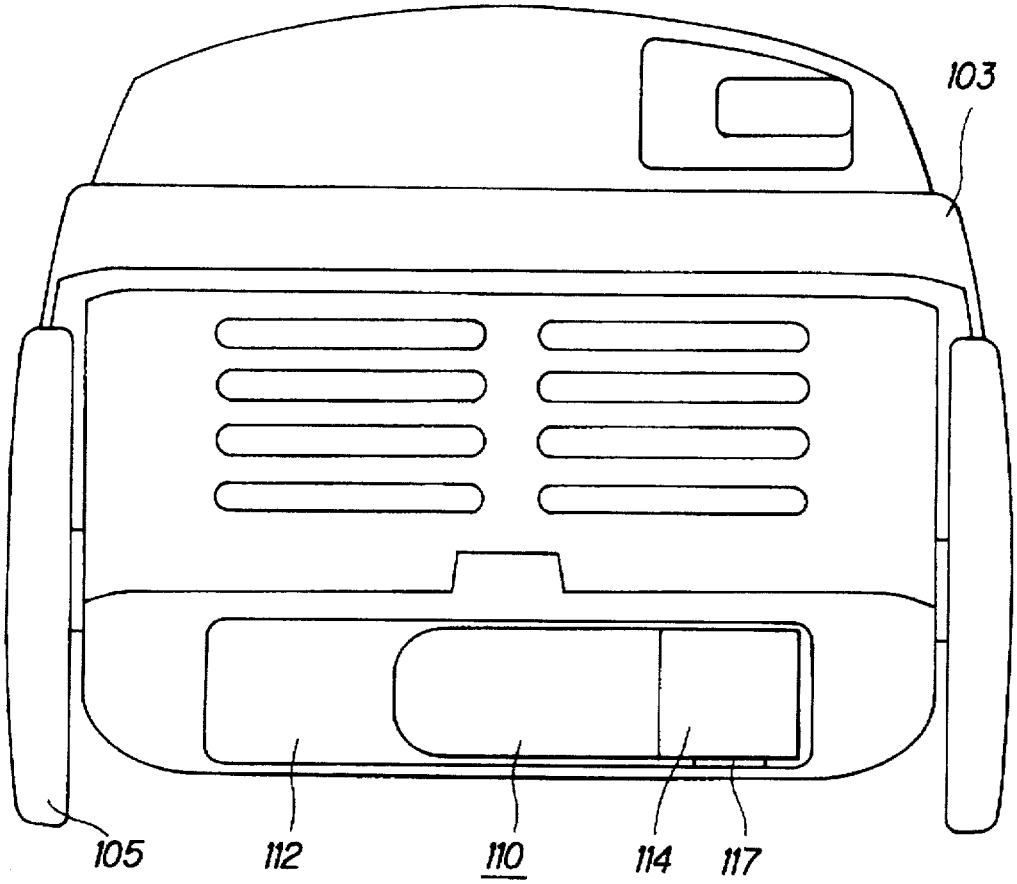
FIG. 29 is a backside view showing a state where only the brush-equipped suction nozzle is fitted in the depressed storage portion in the electric vacuum cleaner in accordance with the fifth embodiment of the present invention.
Figure 30:
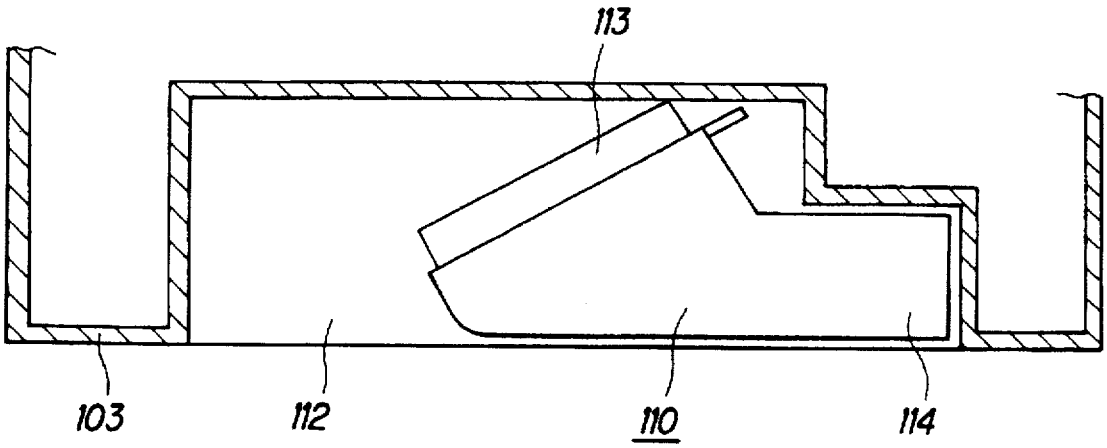
FIG. 30 is a sectional view of the depressed storage portion shown in FIG. 29.

In a case where the brush-equipped suction nozzle 110 is accommodated into the depressed storage portion 112 while the gap-cleaning suction nozzle 111 is being used, when the brush-equipped suction nozzle 110 is inserted in the depressed storage portion 112, the fitting portion 114 of the brush-equipped suction nozzle 110 is snap fitted by the fitting rib 117 of the depressed storage portion 112, whereby only the brush-equipped suction nozzle 110 is stored in the depressed storage portion 112, as shown in FIGS. 29 and 30.

Figure 31:
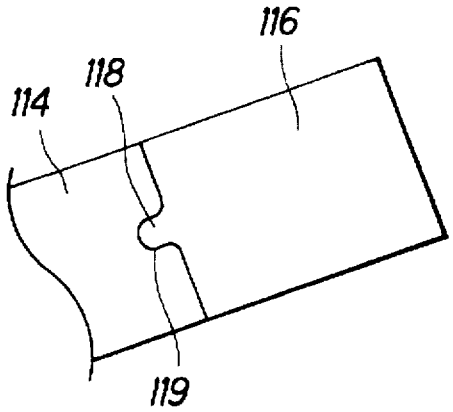
FIG. 31 is a plan view partially showing another example of a state where the gap-cleaning suction nozzle is inserted into the brush-equipped suction nozzle in the electric vacuum cleaner in accordance with the fifth embodiment of the present invention.

In this connection, as shown in FIG. 31, in order to position the gap-cleaning suction nozzle 111 when inserted, it is possible to form a positioning projection 118 on a part of the fitting portion 116 of the gap-cleaning suction nozzle 111 and a positioning recess 119 at a corresponding position to the above positioning projection 118, in the fitting portion 114 of the brush-equipped suction nozzle 110.

Figure 32:
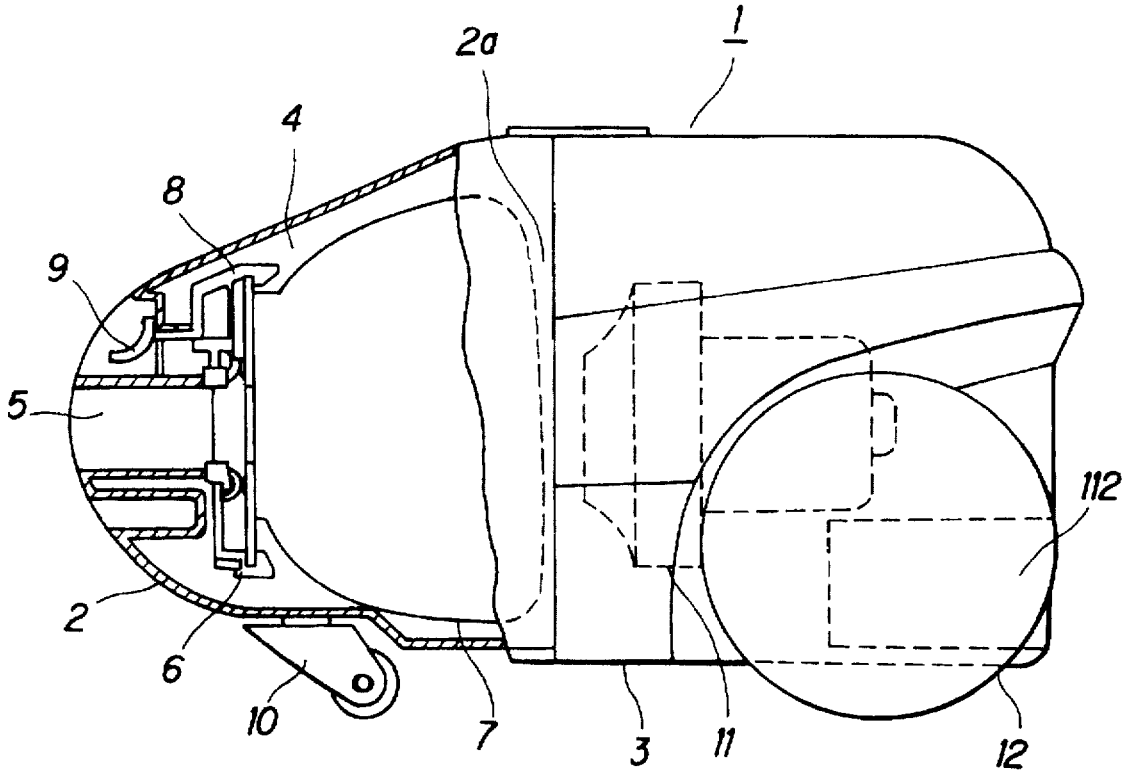
FIG. 32 is a sectional side view showing essential component of an electric vacuum cleaner in accordance with a sixth embodiment of the present invention.

Finally, an electric vacuum cleaner of a sixth embodiment of the present invention will be described with reference to FIG. 32.

The basic configuration of the sixth embodiment of the present invention is that of the first embodiment already described with reference to FIG. 7 and further comprises the feature of the fifth embodiment shown in FIG. 19. That is, in FIG. 32, an appliance housing 1 is formed of separable two components, that is, a dust collecting casing 2 and a motor casing 3. The dust collecting casing 2 is constructed so that the section of the casing 2 becomes gradually greater in width toward an opening 2a or the distal end of the casing 2 where the dust collecting casing 2 is to be joined to the motor casing 3.

The dust collecting casing 2 has a dust collecting chamber 4 where dust and dirt are collected therein. A connecting port 5 for connecting an unillustrated connecting hose is formed on the dust collecting case 2 on the opposite surface to the opening 2a in such a manner that the connecting port 5 is projected to the side of the dust collecting chamber 4. A dust collecting bag 7 having a rectangular (inclusive of square) attachment frame 6 is attached to the connecting port 5 on the side of the dust collecting chamber 4. A catching portion 8 for catching the attachment frame 6 is provided in the dust collecting chamber 4 in the vicinity of the connecting port 5, in order to fix the dust collecting bag 7. A releasing lever 9 for allowing an operator to release the engagement of the catching portion 8 with the dust collecting bag 7 from the outside is integrally formed with the catching portion 8. Provided beneath the dust collecting casing 2 is a roller portion 10 which is able to swivel its roller in conformity with the moving direction of the cleaner. In this arrangement, the embodiment shown in FIG. 32 further includes a depressed storage portion 112 disposed in the lower portion on the backside of the motor casing 3 for accommodating accessory suction nozzles fitted therein such as a brush-equipped suction nozzle 110 and a gap-cleaning suction nozzle 111. Here, the brush-equipped suction nozzle 110 and the gap-cleaning suction nozzle 111 are formed in the same manner as shown in FIGS. 20 through 22.

Since the electric vacuum cleaner of the invention is thus constructed, the replacement of the dust collecting bag can be done by operating the releasing device from the outside of the appliance housing to release the engaged state of the dust collecting bag in the catching device. In consequence, it is possible for the operator to remove the dust collecting bag easily in the single-step operation without requiring any troublesome handling for the replacement.

In addition to the above effect, since, in the electric vacuum cleaner, the storage of the suction nozzles is done by integrally fitting the nozzle portion of the gap-cleaning suction nozzle into the brush-equipped suction nozzle and fitting the integrated suction nozzles to the depressed storage portion, it is possible to reduce the size of the suction nozzles when stored, thus making it possible to reduce the storage space for the suction nozzles. In consequence, the cleaner body can be made compact, whereby it is possible to reduce the storage space for the electric vacuum cleaner itself. Since the weight of the cleaner can also be reduced, it is possible to smoothly move the electric vacuum cleaner when it is used.

Unlike the prior art, there is no need for providing a lid for the storage portion, it is possible to reduce the number of parts as well as to eliminate the possible risk of the lid being damaged.

Since, in the present invention, the dust collecting casing is formed so that the section of the dust collecting casing becomes gradually greater in width toward the opening of the casing; when the appliance housing is separated into the dust collecting casing and the motor casing thereafter the releasing lever is freed with the opening of the dust collecting casing down, it is possible to take the dust collecting bag out by allowing the bag not to be caught between the inner walls of the dust collecting casing but to slide down smoothly. Further, since a groove portion is provided so as not to allow the air-sealing device to project out from the level of the inner wall of the dust collecting casing, the dust collecting bag can be removed smoothly without being caught by the air-sealing device when the dust collecting bag is taken out by sliding it down. Further, Since the air-sealing device is provided inside the peripheral wall of the dust collecting casing, it is possible to form a perfectly hermetic state at the joining surface between the dust collecting casing and the motor casing, without degrading the outside appearance of the appliance housing. Since the blocking device prevents the releasing device from effecting disengagement of the dust collecting bag while the dust collecting casing and the motor casing are being joined, the dust collecting bag will not get out of place unexpectedly during cleaning. Thus it is possible to prevent the appliance from breaking due to the pollution of dust and dirt inside the appliance which would be caused by unexpected disengagement of the dust collecting bag. In addition to the above effects, the operation of the cleaner is disabled by the operation-disabling device when the dust collecting bag is not engaged by the catching device, to thereby warn the operator of the failure to attach the dust collecting bag. In consequence, it is possible to prevent the appliance from breaking due to the pollution of dust and dirt inside the appliance which would be caused by the default of attaching the dust collecting bag.

In the electric vacuum cleaner of the present invention, since the fitting portion of the brush-equipped suction nozzle and the fitting portion of the gap-cleaning suction nozzle have an identical outside diameter; when the brush-equipped suction nozzle is used, it is possible to fit and store the gap-cleaning suction nozzle alone in the depressed storage portion. It is also possible to fit and store the brush-equipped suction nozzle alone in the depressed portion when the gap-cleaning suction nozzle is in use. Consequently, the operator need not keep the unused brush-equipped suction nozzle or gap-cleaning suction nozzle in a convenient place not to disturb the cleaning or need not keep it in one hand, thus making it possible to increase the using performance of the electric vacuum cleaner.

In the electric vacuum cleaner of the present invention, since the length of the front part of the nozzle portion of the gap-cleaning suction nozzle is set up so as not to abut the interior surface of the brush-equipped suction nozzle; when the nozzle portion of the gap-cleaning suction nozzle is inserted into the brush-equipped suction nozzle, it is possible to insert the gap-cleaning suction nozzle into the brush-equipped suction nozzle, with its frontmost part directed to any direction. Consequently, it is possible to easily insert the nozzle portion into the brush-equipped suction nozzle, without adjusting the orientation of the gap-cleaning suction nozzle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric vacuum cleaner comprising:

an appliance body, including a motor casing portion having an electric fan therein and a dust collecting casing portion;

engaging means, disposed in said dust collecting casing portion, for detachably engaging a dust collecting bag; and releasing means, external to said appliance body and integrally connected to said engaging means, for permitting a releasing operation external to the appliance body to disengage the dust collecting bag from said engaging means, wherein the dust collecting bag is thereafter removable from an area of the dust collecting portion which is not proximate to the engaging means.

2. An electric vacuum cleaner comprising:

an appliance housing, composed of and separated into a dust collecting casing having a dust collecting chamber and a motor casing having an electric fan therein; and engaging means, disposed in said dust collecting chamber, for detachably engaging a dust collecting bag, said dust collecting bag being adapted to be removed through an opening of said dust collecting casing where said dust collecting casing is joined to said motor casing, and said dust collecting casing being constructed such that the dust collecting casing gradually increases in width toward said opening of said dust collecting casing;

air-sealing means for hermetically sealing the adjoining area of said dust collecting casing and said motor casing; and a groove portion for prohibiting said air-sealing means from projecting inward toward an inner surface of said dust collecting casing.

3. An electric vacuum cleaner according to claim 1, further comprising:

preventing means for preventing said releasing means from effecting the releasing operation when said dust collecting casing is joined to said motor casing.

4. An electric vacuum cleaner comprising:

an appliance housing, composed of and separated into a dust collecting casing having a dust collecting chamber and a motor casing having an electric fan therein; and engaging means, disposed in said dust collecting chamber, for detachably engaging a dust collecting bag, said dust collecting bag being adapted to be removed through an opening of said dust collecting casing where said dust collecting casing is joined to said motor casing, and said dust collecting casing being constructed such that the dust collecting casing gradually increases in width toward said opening of said dust collecting casing;

an operation-disabling means for disabling the operation of the cleaner when said dust collecting bag is not engaged in said engaging means.

5. The electric vacuum cleaner of claim 1, wherein the dust collecting bag is attached to a frame portion, the frame portion being detachably engaged by the engaging means.

6. The electric vacuum cleaner of claim 5, wherein the engaging means includes a hook-like portion integrally connected to the releasing means, the hook-like portion detachably engaging the frame portion of the dust collecting bag.

7. The electric vacuum cleaner of claim 6, wherein the engaging means further includes a separate receiving portion for receiving a first end of the frame portion, wherein the engaging means detachably engages a second end of the frame portion, opposite the first end.

8. The electric vacuum cleaner of claim 1, wherein the dust collecting portion includes a relatively widest area juxtaposed to the motor casing portion, and the dust collecting portion includes at least one gradually stepped wall which is relatively widest proximate the motor casing portion so as to permit easy removal of the dust collecting bag.

9. The electric vacuum cleaner of claim 1, wherein the dust collecting portion is tapered so as to be relatively widest proximate the motor casing portion to permit easy removal of the dust collecting bag.

* * * * *